US010730286B2

(12) United States Patent
Arakane et al.

(10) Patent No.: US 10,730,286 B2
(45) Date of Patent: Aug. 4, 2020

(54) IMAGE RECORDING APPARATUS

(71) Applicant: BROTHER KOGYO KABUSHIKI KAISHA, Nagoya-shi, Aichi-ken (JP)

(72) Inventors: Satoru Arakane, Nagoya (JP); Kenji Kawamoto, Nagoya (JP); Tsuyoshi Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/443,970

(22) Filed: Jun. 18, 2019

(65) Prior Publication Data

US 2020/0001600 A1 Jan. 2, 2020

(30) Foreign Application Priority Data

Jun. 29, 2018 (JP) ..... 2018-124340

(51) Int. Cl.
*B41J 2/045* (2006.01)
*B41J 25/00* (2006.01)

(52) U.S. Cl.
CPC ..... *B41J 2/04528* (2013.01); *B41J 2/04563* (2013.01); *B41J 2/04586* (2013.01); *B41J 25/001* (2013.01); *B41J 2/04551* (2013.01)

(58) Field of Classification Search
CPC ..... B41J 2/04508; B41J 2/04528; B41J 2/04551; B41J 2/04563; B41J 2/04586; B41J 25/001
See application file for complete search history.

(56) References Cited

U.S. PATENT DOCUMENTS

2005/0195227 A1* 9/2005 Tanaka ..... B41J 29/38 347/10

FOREIGN PATENT DOCUMENTS

JP 2016-137674 A 8/2016

* cited by examiner

*Primary Examiner* — Thinh H Nguyen
(74) *Attorney, Agent, or Firm* — Scully, Scott, Murphy & Presser, PC

(57) ABSTRACT

There is provided an image recording apparatus including a carriage, a head, a velocity sensor, and a controller. The controller obtains velocity data of the carriage from the velocity sensor, determines a threshold value based on the velocity data, records an image on a recording medium, and suspends a recording pass when the controller has determined that a velocity indicated by the velocity data is lower than a velocity corresponding to the threshold value. The controller can execute a first recording mode and a second recording mode in which the velocity of the carriage is faster than that of the first recording mode. The velocity data for the first recording mode is obtained in a warm-up time after a recording command is received until recording of the image is started. The velocity data for the second recording mode is obtained in other time other than the warm-up time.

16 Claims, 21 Drawing Sheets

Fig. 4B

| | RESOLUTION IN CONVEYANCE DIRECTION | RESOLUTION IN SCANNING DIRECTION | TARGET VELOCITY OF CARRIAGE | CONVEYANCE AMOUNT PER ONE CONVEYANCE OPERATION | RECODING TIME | INK DISCHARGE AMOUNT |
|---|---|---|---|---|---|---|
| HIGH IMAGE QUALITY RECORDING MODE | A dpi | C dpi | E dpi | G mm | LONG | LARGE |
| HIGH VELOCITY RECORDING MODE | B dpi | D dpi | F dpi | H mm | SHORT | SMALL |
| | A > B | C > D | E < F | G < H | | |

Fig. 4C

| TEMPERATURE RANGE | ~10°C | 10°C ~ 20°C | 20°C ~ 30°C | 30°C ~ 40°C | 40°C ~ |
|---|---|---|---|---|---|
| THRESHOLD VALUE | THRESHOLD VALUE A | THRESHOLD VALUE B | THRESHOLD VALUE C | THRESHOLD VALUE D | THRESHOLD VALUE E |

IMAGE RECORDING APPARATUS

CROSS REFERENCE TO RELATED APPLICATION

The present application claims priority from Japanese Patent Application No. 2018-124340 filed on Jun. 29, 2018, the disclosure of which is incorporated herein by reference in its entirety.

BACKGROUND

Field of the Invention

The present disclosure relates to an image recording apparatus.

Description of the Related Art

There is publicly known, as an image recording apparatus, a serial-type printer in which ink is discharged from a printing head on a sheet while a carriage carrying the printing head moves in a scanning direction. The above printer determines, in printing, whether a carriage velocity is lower than a threshold value set in advance. When the printer has determined that the carriage velocity is lower than the threshold value, the printer determines that a jam is caused in the printer and the printer stops movement of the carriage.

The carriage velocity depends, for example, on the change in environment where the printer is used. Thus, when the same threshold value is used without taking the change in use environment and the like into consideration, the carriage velocity may become lower than the threshold value due to the change in use environment and the like, even though the printer is not jammed. The printer may thus erroneously determine that the printer is jammed.

In view of the above, the publicly known printer executes a velocity obtaining operation (velocity measuring operation) for obtaining (measuring) velocity data of the carriage during movement of the carriage. Then, the printer sets the threshold value based on the velocity data obtained through the velocity obtaining operation. The publicly known printer has multiple recording modes (printing modes). For example, when the printer is turned on and/or when the printer recovers from a power save mode, the printer executes the velocity obtaining operation and sets the threshold value for each recording mode.

SUMMARY

However, the use environment and the like may vary after the printer is turned on and/or after the printer recovers from the power save mode. In that case, the threshold value that is set based on the velocity obtaining operation executed when the printer is turned on and/or when the printer recovers from the power save mode may not be a value that corresponds accurately to the use environment and the like. In order to make the threshold value used for image recording the value that corresponds accurately to the use environment, the velocity obtaining operation is required to be executed after a recording command for the image recording is received and the threshold value is required to be set based on velocity data obtained through the velocity obtaining operation. In the following, setting the threshold value that corresponds accurately to the use environment is referred to as making the threshold value exact. Namely, in order to set an exact threshold value, the velocity obtaining operation is required to be executed after the recording command is received. However, if the printer executes the velocity obtaining operation after receiving the recording command, a first print-out time (hereinafter referred to as FPOT) would lengthen. The FPOT is a time after the printer receives the recording command until the first sheet for which an image is recorded is discharged from the printer.

Here, which one of making the threshold value exact and shortening the FPOT is given priority may depend on characteristics of the respective recording modes. For example, in the recording mode having a shorter recording time than others, shortening the FPOT should be typically given priority over making the threshold value exact.

An object of the present disclosure is to provide an image recording apparatus that is capable of executing a velocity obtaining operation for obtaining carriage velocity data during movement of a carriage at appropriate timing depending on each recording mode.

According to an aspect of the present disclosure, there is provided an image recording apparatus, including: a carriage configured to move in a scanning direction; a head carried on the carriage and configured to discharge a liquid; a velocity sensor configured to obtain velocity data related to a velocity of the carriage, and a controller. The controller is configured to: control the velocity sensor to obtain the velocity data while controlling the carriage to move; determine a threshold value based on the velocity data; execute, in a case of receiving a recording command, a recording pass in which the liquid is discharged from the head toward a recording medium during movement of the carriage to record an image on the recording medium; determine in execution of the recording pass whether a velocity indicated by the velocity data is lower than a velocity corresponding to the threshold value; and suspend the recording pass in a case that the controller has determined in execution of the recording pass that the velocity indicated by the velocity data is lower than the velocity corresponding to the threshold value. The controller is configured to: select a recording mode related to recording of the image from among a first recording mode and a second recording mode in which the velocity of the carriage in the recording pass is faster than the first recording mode and obtain the velocity data and determine the threshold value for each of the first recording mode and the second recording mode, the velocity data for the first recording mode is obtained in a warm-up time after the recording command is received until recording of the image is started, and the velocity data for the second recording mode is obtained in any other time than the warm-up time.

When compared to the second recording mode, the first recording mode having a slower carriage velocity typically takes a longer time for image recording and uses a larger amount of liquid discharged on the recording medium, thus easily causing a paper jam. The first recording mode is thus required to give priority to the accuracy of the threshold value over the reduction of FPOT. In view of the above, the velocity obtaining operation for the first recording mode is executed in the warm-up time. This allows the threshold value for the first recording mode to be set accurately. The velocity obtaining operation for the second recording mode is executed in any other time than the warm-up time. In that case, the time after the recording command is received until image recording is started can be shortened in the second recording mode, thus reducing the FPOT. Accordingly, the velocity obtaining operation is executed at appropriate timing depending on each recording mode.

BRIEF DESCRIPTION OF THE DRAWINGS

FIG. 4B illustrates recording modes, and FIG. 4C illustrates a threshold value table according to the second embodiment.

DESCRIPTION OF THE EMBODIMENTS

First Embodiment

Figure 1:
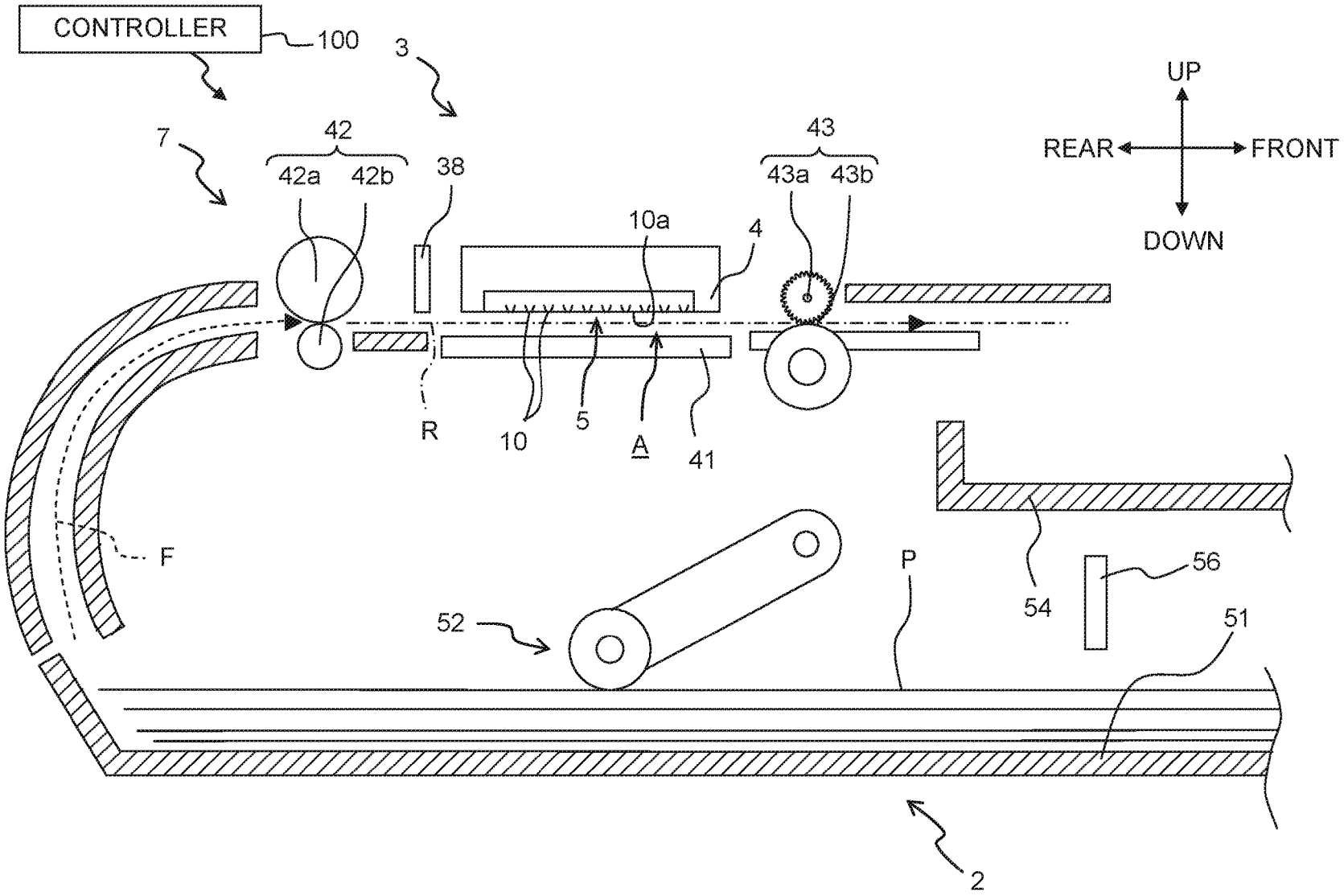
FIG. 1 is a vertical cross-sectional view schematically depicting an ink-jet printer according to the first embodiment.
Figure 2:
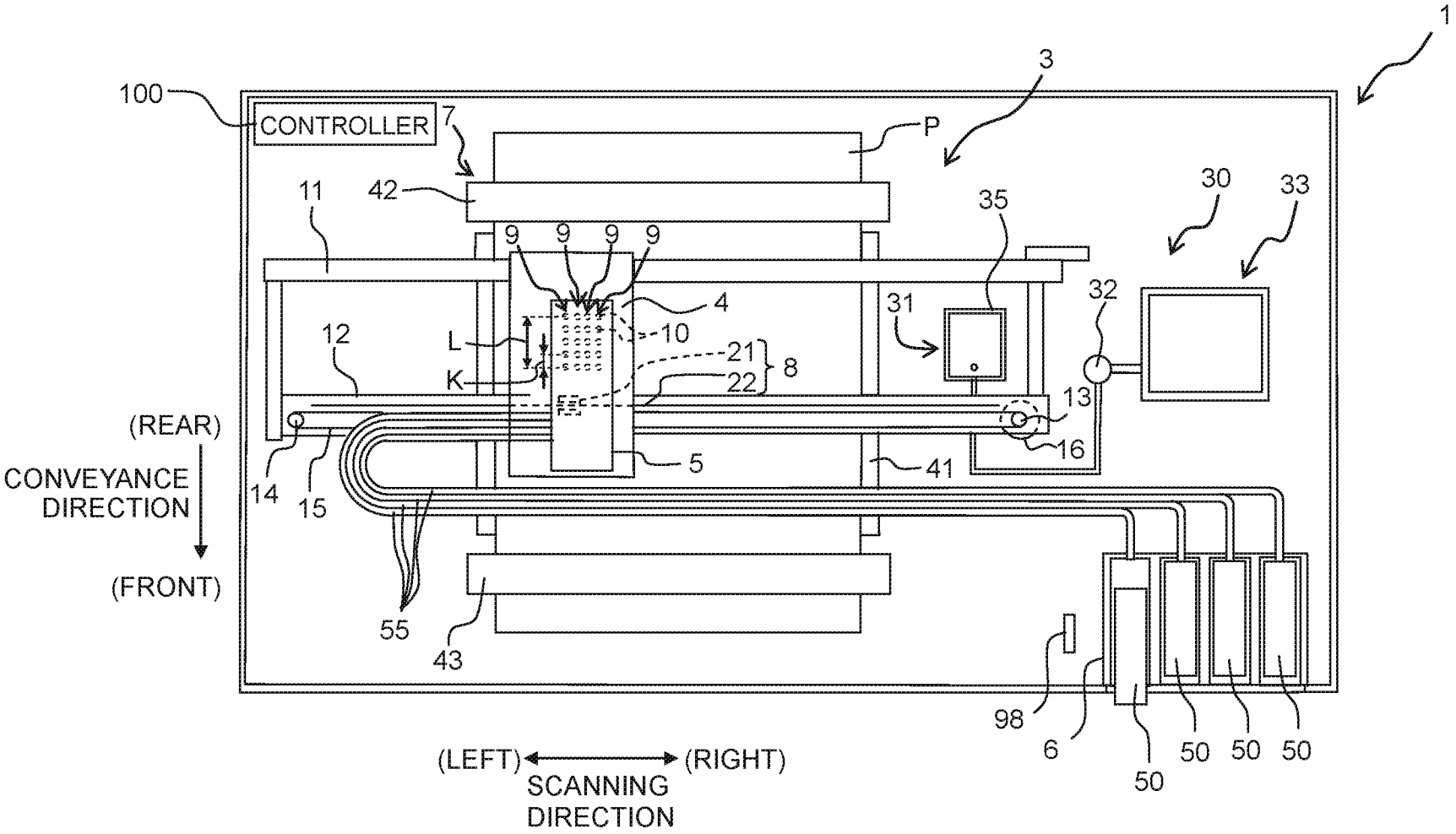
FIG. 2 is a plan view schematically depicting the ink-jet printer.

In the following, an image recording apparatus is explained by using an ink-jet printer 1 as an example. A front-rear direction, left-right direction, and up-down direction which are orthogonal to each other are defined as depicted in FIGS. 1 and 2. As depicted in FIG. 1, the printer 1 includes a feeder 2, a recording unit 3, a controller 100, and the like.

The feeder 2 includes a feed tray 51 that accommodates a sheet P as a recording medium, a pick up roller 52 provided above the feed tray 51, and a feed route F through which the sheet P passes. The feed route F curves upward from an upper end of a rear wall of the feed tray 51 and reaches a conveyance roller pair 42 described below. When the controller 100 controls and drives a feed motor 53 (see FIG. 4A), the pickup roller 52 picks up each sheet P from the feed tray 51 one by one. The sheet P picked up by the pickup roller 52 is supplied to the recording unit 3 through the feed route F.

A remaining sheet detection sensor 56 is disposed above the feed tray 51. The remaining sheet detection sensor 56 detects a remaining amount of sheets P accommodated in the feed tray 51. The remaining sheet detection sensor 56 outputs the detection result to the controller 100. In the first embodiment, the remaining sheet detection sensor 56 measures a position in the up-down direction of an upper surface of the uppermost sheet P or a distance between the sensor 56 and the upper surface of the uppermost sheet P, and then the remaining sheet detection sensor 56 detects the remaining amount of sheets P based on the measuring result. A mechanical sensor, an optical sensor, or the like may be used as the remaining sheet detection sensor 56. For example, when a light refection type optical sensor, which includes a light emitting element and a light receiving element, is used as the remaining sheet detection sensor 56, the sensor may emit light to the upper surface (measurement target) of the uppermost sheet P accommodated in the feed tray 51, measure a distance between itself and the upper surface of the uppermost sheet P based on a reflection light amount, and detect the remaining amount of sheets P based on the measuring result.

As depicted in FIG. 2, the recording unit 3 includes a carriage 4, an ink-jet head 5 (hereinafter referred to as a head 5), a holder 6, a conveyor 7, an encoder 8, a purge apparatus 30, a temperature sensor 98, a touch panel 99 (see FIG. 4A), and the like. The carriage 4 is supported by two guide rails 11 and 12 extending in the left-right direction. The two guide rails 11 and 12 are arranged in the front-rear direction at an interval interposed therebetween. Pulleys 13 and 14 are provided on an upper surface of the guide rail 12 at both ends in the left-right direction. An endless belt 15, which is made by using a rubber material, is wound around the pulleys 13 and 14. The carriage 4 is attached to part of the belt 15 between the pulleys 13 and 14. A carriage motor 16 is connected to the right pulley 13. Rotating the carriage motor 16 forwardly and reversely rotates the pulleys 13 and 14, which causes the belt 15 to run. The carriage 4 thus reciprocates in the left-right direction, which is a scanning direction. Traveling of the belt 15 rotates the left pulley 14.

The holder 6 is disposed in front of the carriage 4. Four ink cartridges 50 are removably installed in the holder 6. Each of the four ink cartridges 50 contains the corresponding one of black, yellow, cyan, and magenta inks.

The head 5, which is carried on the carriage 4, reciprocates in the scanning direction together with the carriage 4. The head 5 is removably connected to first ends of four flexible ink supply tubes 55. The holder 6 is connected to second ends of the four ink supply tubes 55. Specifically, the four ink supply tubes 55 extend leftward from the connection portions with the head 5, turn to change the extending direction at the left of the head 5 in the printer 1, extend rightward, and are connected to the holder 6. Inks in the four ink cartridges 50 installed in the holder 6 are supplied to the head 5 through the four ink supply tubes 55, respectively.

A lower surface of the head 5 is a nozzle surface 10*a* (see FIG. 1) in which nozzles 10 are open. The inks are discharged from the nozzles 10. The nozzles 10 are arranged in the front-rear direction at intervals K to form a nozzle row 9 having a length L. The head 5 includes four nozzle rows 9, which are arranged in the scanning direction. Black ink is discharged from nozzles 10 belonging to the rightmost nozzle row 9 in the scanning direction, yellow ink is discharged from nozzles 10 belonging to the second rightmost nozzle row 9 in the scanning direction, cyan ink is discharged from nozzles 10 belonging to the third rightmost nozzle row 9 in the scanning direction, and magenta ink is discharged from nozzles 10 belonging to the leftmost nozzle row 9 in the scanning direction.

The head 5 includes ink channels that correspond to the respective colors of inks and communicate with the nozzles 10. The head 5 includes an actuator provided with driving elements by which pressure is applied to the inks in the ink channels to discharge the inks from the nozzles 10. The actuator may be any actuator. For example, the present disclosure may preferably use a piezoelectric actuator including, as the driving elements, piezoelectric elements which apply pressure to the inks through deformation of a piezoelectric layer due to inverse piezoelectric effect. As the driving elements, the present disclosure may use heat generating elements for generating bubbles in the inks by heat.

The conveyor 7 conveys the sheet P fed from the feeder 2 in the front-rear direction, which is a conveyance direction. The conveyance direction (front-rear direction) is orthogonal to the scanning direction. As depicted in FIG. 1, the conveyor 7 includes a platen 41, a conveyance route R, and two conveyance roller pairs 42, 43.

The platen 41 is disposed below the carriage 4 to face the carriage 4. The platen 41 is longer in the left-right direction than the sheet P. The platen 41 supports the sheet P from below during image recording.

The conveyance route R extends straight from the conveyance roller pair 42 toward the front side. The conveyance roller pair 42 is disposed upstream of the conveyance roller pair 43 in the conveyance route R.

The two conveyance roller pairs 42 and 43 are arranged in the front-rear direction with the platen 41 interposed therebetween. The conveyance roller pair 42 is disposed upstream of the platen 41 in the conveyance direction. The conveyance roller pair 42 has an upper roller 42*a* and a lower roller 42*b*. The sheet P fed from the feeder 2 is conveyed along the conveyance route R in the conveyance direction while being nipped by the rollers 42*a* and 42*b* in the up-down direction. The upper roller 42*a* is a drive roller driven by a conveyance motor 45 (see FIG. 4A). The lower roller 42*b* is a driven roller that rotates along with rotation of the upper roller 42*a*.

The conveyance roller pair 43 is disposed downstream of the platen 41 in the conveyance direction. The conveyance roller pair 43 has an upper roller 43*a* and a lower roller 43*b*. The rollers 43*a* and 43*b* receive the sheet P from the conveyance roller pair 42, and convey the sheet P in the conveyance direction while nipping it in the up-down direction. The lower roller 43*b* is a drive roller driven by the conveyance motor 45 (see FIG. 4A). The upper roller 43*a*, which is a spur, is a driven roller that rotates along with rotation of the lower roller 43*b*.

The controller 100 controls the conveyance motor 45 to rotate the conveyance roller pairs 42 and 43 so that the conveyance roller pairs 42 and 43 are synchronized to each other. The conveyance roller pairs 42 and 43 convey the sheet P along the conveyance route R. The sheet P is thus conveyed to an area A (see FIG. 1, hereinafter referred to as a facing area A) above the platen 41 where the sheet P faces the carriage 4. A rotary encoder 40 (see FIG. 4A) is provided in a rotation shaft of the conveyance roller pair 42. The rotary encoder 40 outputs a pulse signal depending on rotation of the conveyance roller pair 42. The controller 100 controls conveyance of the sheet P based on the pulse signal from the rotary encoder 40.

As depicted in FIG. 1, a sheet sensor 38 is provided upstream of the conveyance roller pair 43 in the conveyance direction. The sheet sensor 38 detects whether the sheet P is in a detection position, which is positioned in the conveyance route R at the upstream side in the conveyance direction from the conveyance roller pair 43. The controller 100 determines whether the sheet P is in the facing area A based on the detection result of the sheet sensor 38 and the control content for the conveyance motor 45.

The controller 100 alternately repeats a recording pass and a conveyance operation. In the recording pass, the ink(s) is/are discharged during movement in the left-right direction of the carriage 4 and the head 5 in a state where the sheet P is in the facing area A. In the conveyance operation, the sheet P is conveyed in the conveyance operation by use of the conveyance roller pairs 42 and 43. Accordingly, a desired image or the like is recorded on a surface of the sheet P facing the head 5. Namely, the printer 1 of the first embodiment is a serial type ink-jet printer.

In the head 5, four kinds (large droplet, medium droplet, small droplet, non-discharge) of discharge amounts of ink (volumes of ink droplet) can be discharged from each nozzle 10 during one discharge period to record an image on the sheet P. Four levels of density depending on the ink jetting amounts can thus be expressed by dots formed on the sheet P. The discharge period is a time required for moving the head 5 by a distance corresponding to a resolution in the scanning direction.

Figure 3A:
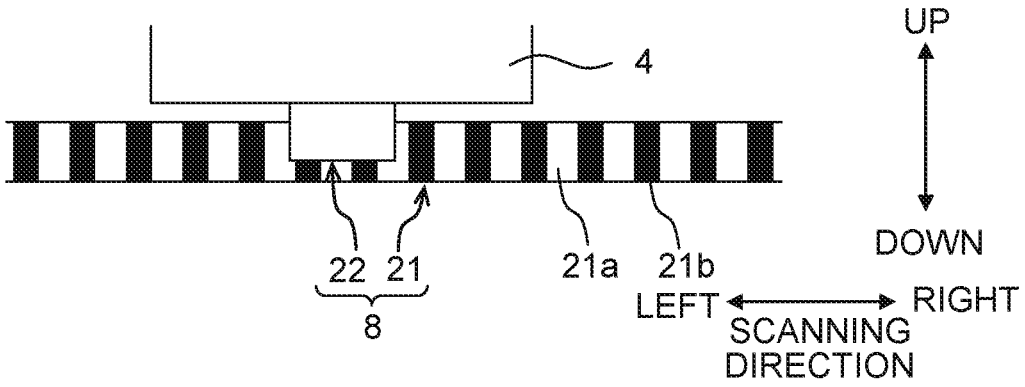
FIG. 3A depicts arrangement of a detection sensor and a scale of an encoder.

As depicted in FIGS. 2 and 3, the encoder 8, which is a transmissive linear encoder, includes a scale 21 and a detection sensor 22. The scale 21 is disposed on the upper surface of the guide rail 12. The scale 21 extends in the scanning direction over a range in which the carriage 4 is movable. As depicted in FIG. 3A, the scale 21 includes transmissive areas 21*a* and non-transmissive areas 21*b* that are alternately arranged in the scanning direction. The transmissive areas 21*a* are constant in length in the scanning direction and the non-transmissive areas 21*b* are constant in length in the scanning direction. Namely, the scale 21 includes the transmissive areas 21*a* arranged in the scanning direction at predefined intervals (at intervals each corresponding to the length in the scanning direction of the non-transmissive area 21*b*) and the non-transmissive areas 21*b* arranged in the scanning direction at predefined intervals (at intervals each corresponding to the length in the scanning direction of transmissive area 21*a*). Light is transmitted through the transmissive areas 21*a*. When compared to the transmissive areas 21*a*, light is less likely to be transmitted through the non-transmissive areas 21*b*.

The detection sensor 22, which is carried on the carriage 4, includes a light emitting element 26 and a light receiving element 27. The light emitting element 26 and the light receiving element 27 are arranged in the front-rear direction with the scale 21 interposed therebetween. The light emitting element 26 emits light toward the light receiving element 27. The light receiving element 27 receives the light emitted from the light emitting element 26. The detection position of the detection sensor 22 is a position on the scale 21 between the light emitting element 26 and the light receiving element 27, and the detection sensor 22 detects the transmissive area 21*a* or the non-transmissive area 21*b* at the detection position.

Figure 3B:
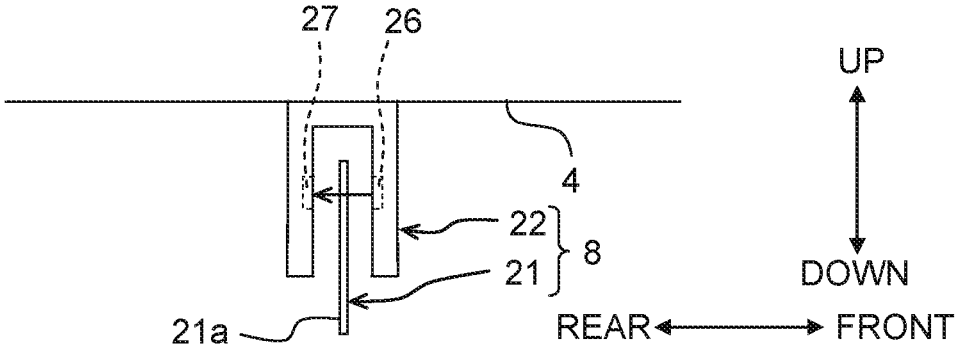
FIG. 3B depicts a state where the detection sensor faces a transmissive area.
Figure 3C:
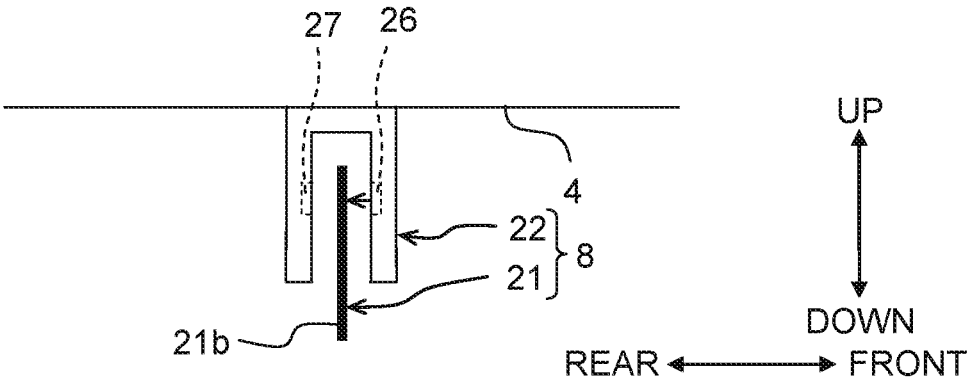
FIG. 3C depicts a state where the detection sensor faces a non-transmissive area.

Specifically, as depicted in FIG. 3B, when the transmissive area 21*a* is positioned at the detection position of the detection sensor 22, light emitted from the light emitting element 26 is transmitted through the transmissive area 21*a* and is received by the light receiving element 27. Meanwhile, as depicted in FIG. 3C, when the non-transmissive area 21*b* is positioned at the detection position of the detection sensor 22, light emitted from the light emitting element 26 does not reach the light receiving element 27 by being blocked by the non-transmissive area 21*b*. Thus, when the carriage 4 moves in the scanning direction to change the areas positioned at the detection position of the detection sensor 22, the light receiving element 27 alternately repeats a state where the light receiving element 27 receives light from the light emitting element 26 and a state where the light receiving element 27 does not receive light from the light emitting element 26. The electrical potential of the detection sensor 22 is a potential V1 when the light receiving element 27 does not receive light from the light emitting element 26. The electrical potential of the detection sensor 22 is a potential V2 (V2<V1) when the light receiving element 27 receives light from the light emitting element 26. Namely, when the pulse signal output from the detection sensor 22 has the potential V1, the detection sensor 22 detects the non-transmissive area 21*b*. When the pulse signal output from the detection sensor 22 has the potential V2, the detection sensor 22 detects the transmissive area 21*a*.

The controller 100 obtains, for example, a velocity of the carriage 4 (hereinafter referred to as a carriage velocity Vcr) based on the detection result of the detection sensor 22. The carriage velocity Vcr can be calculated in accordance with the following equation (1). In the equation (1), W means a width in the scanning direction of one non-transmissive area 21*b*, and G means frequency of a clock signal output from an oscillation circuit 105 (see FIG. 4A). CK means the number of clocks of the clock signal output from the oscillation circuit 105 while the detection sensor 22 detects one non-transmissive area 21*b*.

$$Vcr=W/(CK/G) \quad (1)$$

In the equation (1), the width W and the frequency G are fixed values that are determined in advance. The controller 100 can thus calculate the carriage velocity Vcr by obtaining the number of clocks CK. Obtaining the number of clocks CK and calculating the carriage velocity Vcr are executed every time the detection sensor 22 detects the non-transmissive area 21*b*. In the first embodiment, the carriage velocity Vcr corresponds to velocity data of the present disclosure. A combination of the encoder 8 and the controller 100 corresponds to a velocity sensor of the present disclosure.

The purge apparatus 30 executes a maintenance operation to inhibit the deterioration in discharge performance of the head 5 and to recover the discharge performance. As depicted in FIG. 2, the purge apparatus 30 includes a cap unit 31, a suction pump 32, a waste liquid tank 33, and the like.

The cap unit 31 is disposed on the right of the platen 41. When the carriage 4 moves rightward beyond the platen 41, the carriage 4 faces the cap unit 31 in the up-down direction. The cap unit 31 is driven by a motor 34 (see FIG. 4A) to move up and down in the up-down direction. The cap unit 31 includes a cap 35 that can be attached to the head 5 by being brought into contact therewith. The cap 35 is made by using, for example, a rubber material.

The cap 35 faces the nozzle surface 10*a* in a state where the head 5 faces the cap unit 31. In the above situation, when the motor 34 moves the cap unit 31 upward from a separate position to a capping position, the cap unit 31 is attached to the head 5. This allows the cap 35 to cover all of the nozzles 10 belonging to the four nozzle rows 9. The cap 35 is connected to the suction pump 32, which is a rotary pump. A tube pump may be used as the suction pump 32.

The printer 1 executes a suction purge. In the suction purge, the controller 100 controls and drives the suction pump 32 in a state where the cap 35 is attached to the head 5 to cover the nozzles 10, thus reducing pressure (performing suction) inside the cap 35. Accordingly, the inks are sucked and discharged from the nozzles 10. The suction purge allows high viscosity inks in the nozzles 10 to be forcibly discharged from the nozzles 10, thus recovering the discharge performance of the head 5, and the like. The inks discharged through the suction purge are held in the waste liquid tank 33.

Before shipping the head 5 from a factory, ink channels and the like in the head 5 are filled with a preservation liquid to preserve functions of the head 5. As the preservation liquid, a liquid having a smaller amount of color material of dye or pigment than ink or a liquid not containing the color material of dye or pigment is used. After the shipment, when a user turns on the printer 1 provided with the head 5 for the first time, the controller 100 executes initial introduction processing in which the preservation liquid in the ink channels of the head 5 is replaced by inks introduced from the ink cartridges 50. Specifically, in the initial introduction processing, the controller 100 discharges the liquid in the head 5 from the nozzles 10 by causing the purge apparatus 30 to execute the suction purge. This introduces the inks from the ink cartridges 50 to the head 5 by an amount corresponding to the liquid discharged from the nozzles 10.

A temperature sensor 98 (a temperature sensor of the present disclosure) measures an ambient temperature. The temperature sensor 98 is disposed in the vicinity of the conveyor 7. A touch panel 99 is a user interface by which a user confirms acceptance of input of a variety of operations, various setting screens, operation states, and the like displayed thereon.

Figure 4A:
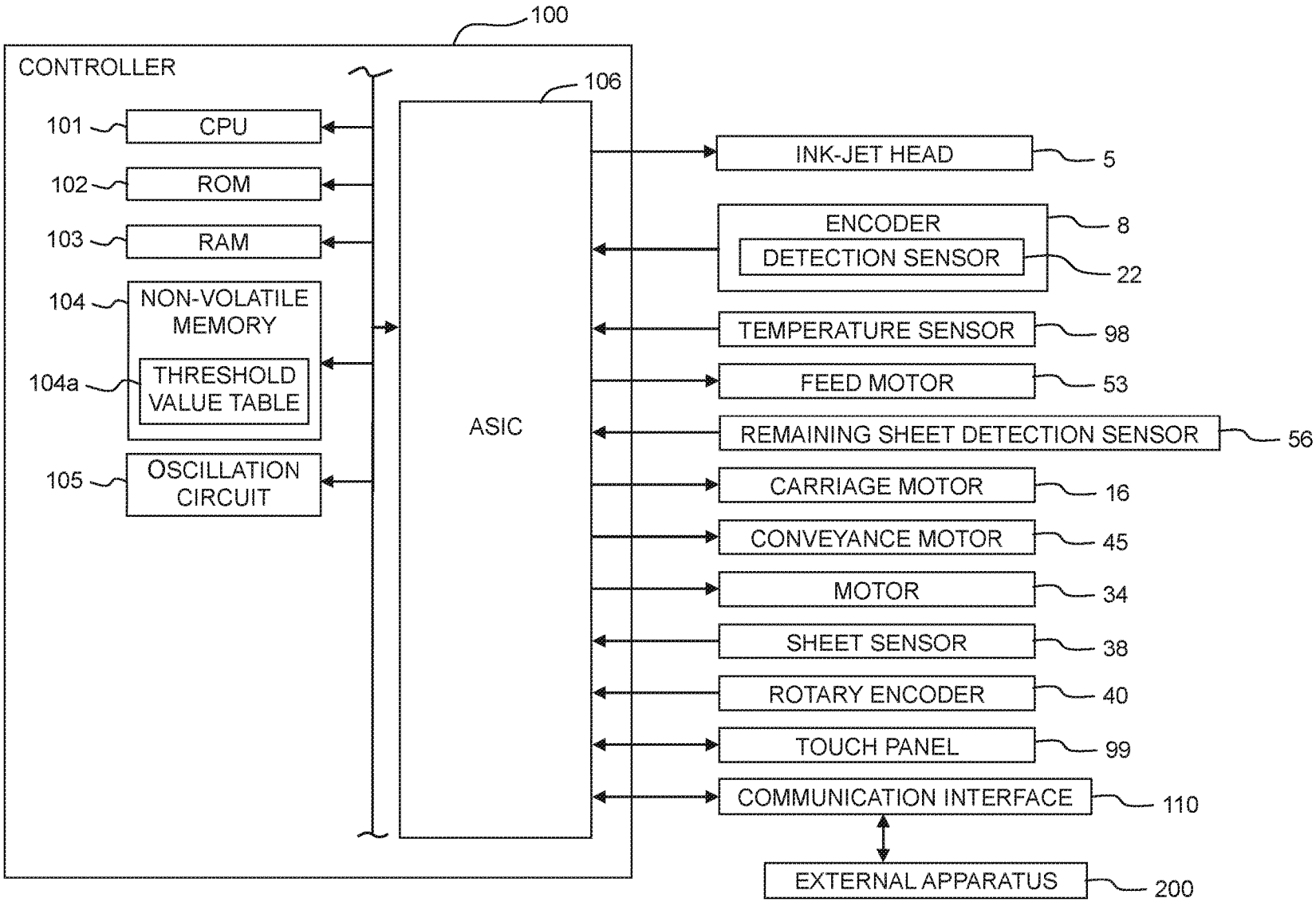
FIG. 4A is a block diagram depicting an electrical configuration of the ink-jet printer.

As depicted in FIG. 4A, the controller 100 includes a Central Processing Unit (CPU) 101, a Read Only Memory (ROM) 102, a Random Access Memory (RAM) 103, a non-volatile memory 104, the oscillation circuit 105, an application specific integrated circuit (ASIC) 106, and the like. The ROM 102 stores programs executed by the CPU 101, a variety of fixed data, and the like. The RAM 103 temporality stores data (image data and the like) required for executing the programs. The non-volatile memory 104 (a memory of the present disclosure) stores, for example, a threshold value table 104*a* described below. The oscillation circuit 105 outputs the clock signal having predefined frequency. The ASIC 106 is connected to a variety of apparatuses or driving units of the printer 1, such as the head 5, the detection sensor 22, the carriage motor 16, the conveyance motor 45, and a communication interface 110.

The controller 100 executes a variety of processing, such as recording processing for recording an image on the sheet P, by executing the programs stored in the ROM 102. The following explanation is made on the assumption that the CPU 101 executes a variety of processing. However, only the ASIC 106 may execute a variety of processing, or the CPU 101 may cooperate with the ASIC 106 to execute a variety of processing. The controller 100 may include multiple CPUs and the CPUs may execute processing in a shared fashion. Or, the controller 100 may include multiple ASICs and the ASICs may execute processing in a shared fashion. In the following, the recording processing is explained in detail.

The CPU 101 executes the recording processing when receiving a recording command from an external apparatus 200, such as a personal computer (PC), via the communication interface 110. Specifically, when receiving the recording command, the controller 100 first executes image processing, such as a well-known error diffusion processing (quantization processing), on image data to be recorded that is stored in the RAM 103, thus generating discharge data ED.

Figure 5A:
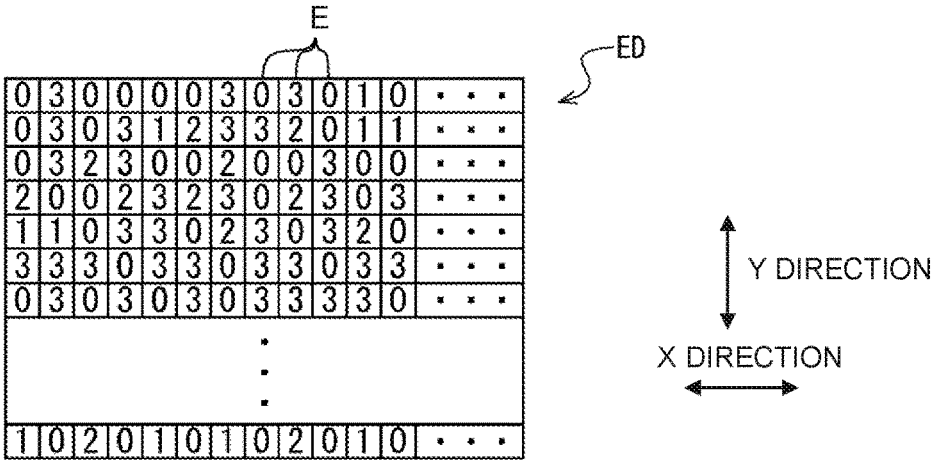
FIG. 5A illustrates discharge data.

As depicted in FIG. 5A, the discharge data ED is data of four gradations, which correspond to four kinds of discharge amounts of ink that can be discharged from each nozzle 10 during one discharge period. The discharge data ED includes multiple dot elements E corresponding to multiple dots to be formed on the sheet P. The multiple dots include non-discharge dot(s) where no ink lands on the sheet P. Specifically, the discharge data ED is formed by the dot elements E arranged in an X direction and a Y direction that are orthogonal to each other. The X direction corresponds to the scanning direction, and the Y direction corresponds to the conveyance direction. The discharge amount of ink from each nozzle 10 to form the dot is determined for each dot element E. Specifically, any one of the four kinds of discharge amounts (large droplet, medium droplet, small droplet, non-discharge) is determined for each dot element E. In the discharge data ED depicted in FIG. 5A, the numeral 3 means a dot element E where the large droplet is set, the numeral 2 means a dot element E where the medium droplet is set, the numeral 1 means a dot element E where the small droplet is set, and the numeral 0 means a dot element E where the non-discharge is set.

The number of dot elements E included in the discharge data ED depends on a resolution of an image to be recorded on the sheet P. Namely, in the recording processing, the number of dot elements E aligned in the X direction increases as the resolution in the scanning direction of the image to be recorded on the sheet P is higher; the number of dot elements E aligned in the Y direction increases as the resolution in the conveyance direction of the image to be recorded on the sheet P is higher.

After that, the CPU 101 controls the pickup roller 52 and the conveyance motor 45 to convey the sheet P from the feed tray 51 to the facing area A. Then, the CPU 101 determines whether the sheet P is in the facing area A based on the detection result of the sheet sensor 38 and the like. When the CPU 101 determines that the sheet P is in the facing area A, the CPU 101 starts image recording based on the discharge data ED generated. Namely, the CPU 101 records an image based on the discharge data ED on the recording surface of the sheet P facing the head 5 by alternately performing the recording pass and the conveyance operation.

In one recording pass, in order to uniformly move the carriage 4 at a target velocity that is the maximum velocity of the carriage 4 in the recording pass, the CPU 101 controls movement of the carriage 4 by using feedback control based on the current carriage velocity Vcr obtained from the detection result of the detection sensor 22 and a deviation between the current carriage velocity Vcr and the target velocity. The printer 1 can select the target velocity of the carriage 4 in the recording pass from among multiple levels of velocities. The CPU 101 determines any one of the multiple levels of velocities as the target velocity, and controls the carriage motor 16 to uniformly move the carriage 4 at the target velocity in the recording pass.

The printer 1 of the first embodiment records an image in accordance with unidirectional recording in which the recording pass is executed only when the carriage 4 moves toward one side in the scanning direction (the right side in the first embodiment). The CPU 101 is thus required to execute a return operation, as follows. Namely, after executing one recording pass by moving the carriage 4 rightward, the carriage 4 is made to move leftward without discharging ink from the head 5 before the next recording pass is started. The CPU 101 can select the target velocity of the carriage 4 in the return operation from among multiple levels of velocities. The controller 100 determines any one of the multiple levels of velocities as the target velocity depending on a movement range in which the carriage 4 moves in the return operation. In the return operation, the controller 100 controls the carriage motor 16 to uniformly move the carriage 4 at the target velocity.

In the first embodiment, the printer 1 includes two recording modes as recording modes in the recording processing. The two recording modes are a high image quality recording mode (a first recording mode of the present disclosure) and a high velocity recording mode (a second recording mode of the present disclosure). As depicted in FIG. 4B, the resolution of the image to be recorded on the sheet P using the high image quality recording mode is higher than that using the high velocity recording mode. Specifically, both the resolution in the conveyance direction and the resolution in the scanning direction using the high image quality recording mode are higher than those using the high velocity recording mode. Meanwhile, the target velocity of the carriage 4 in the recording pass using the high velocity recording mode is faster than that using the high image quality recording mode. The high velocity recording mode and the high image quality recording mode are described below in detail.

In the high velocity recording mode, the resolution in the conveyance direction is a reference resolution (e.g., 300 dpi) that corresponds to the spaced intervals K between the nozzles 10. Meanwhile, in the high image quality recording mode, the resolution in the conveyance direction is as twice as the reference resolution (e.g., 600 dpi). The reference resolution that corresponds to the spaced intervals K between the nozzles 10 is a resolution when dots are arranged in the conveyance direction at the spaced intervals K between the nozzles 10.

Figure 5B:
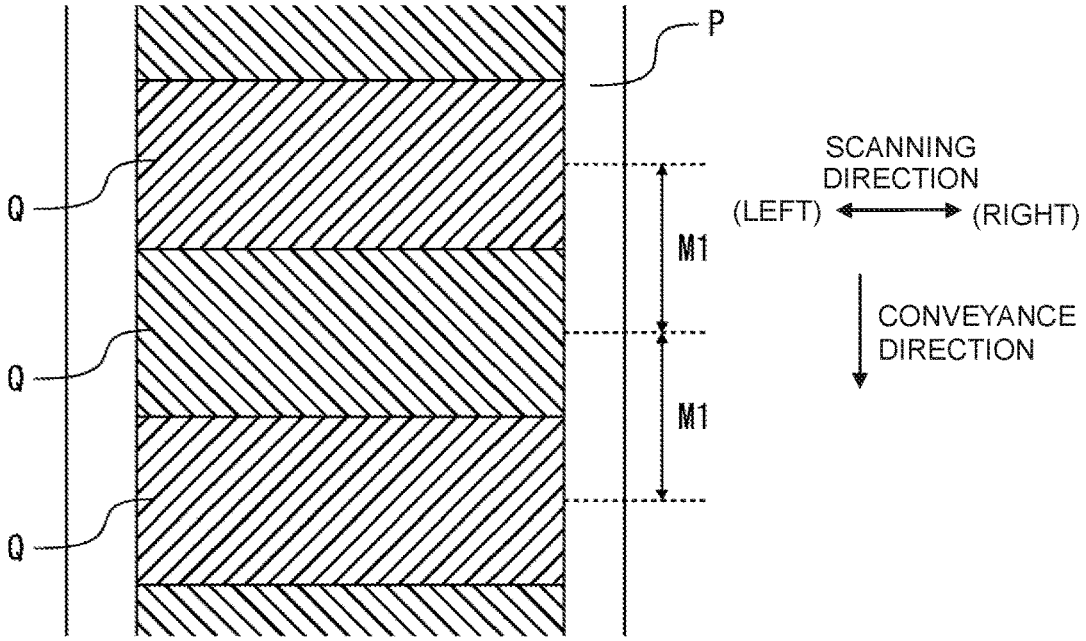
FIG. 5B illustrates recording areas of recording passes using a high velocity recording mode.

In the high velocity recording mode, the sheet P is conveyed in the conveyance operation by a first conveyance amount M1 that is the same length as the length L of each nozzle row 9. In that configuration, as depicted in FIG. 5B, of two recording areas Q where the image is recorded by two consecutive recording passes, a downstream end in the conveyance direction of the recording area Q where the image is recorded by the preceding recording pass has the same position, in the conveyance direction, as an upstream end in the conveyance direction of the recording area Q where the image is recorded by the succeeding recording pass. Namely, the recording areas Q where the image is recorded by the two consecutive recording passes do not overlap with each other.

Figure 5C:
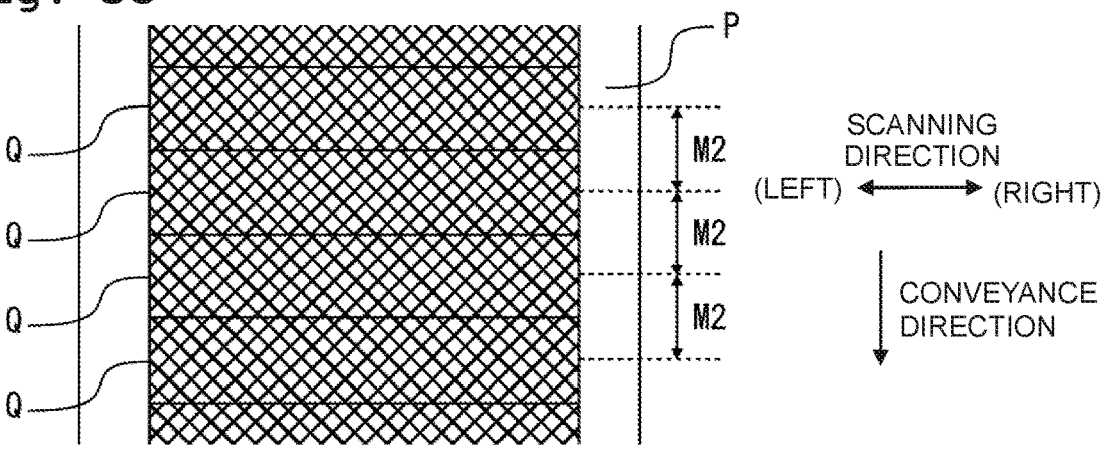
FIG. 5C illustrates recording areas of recording passes using a high image quality recording mode.
Figure 6A:
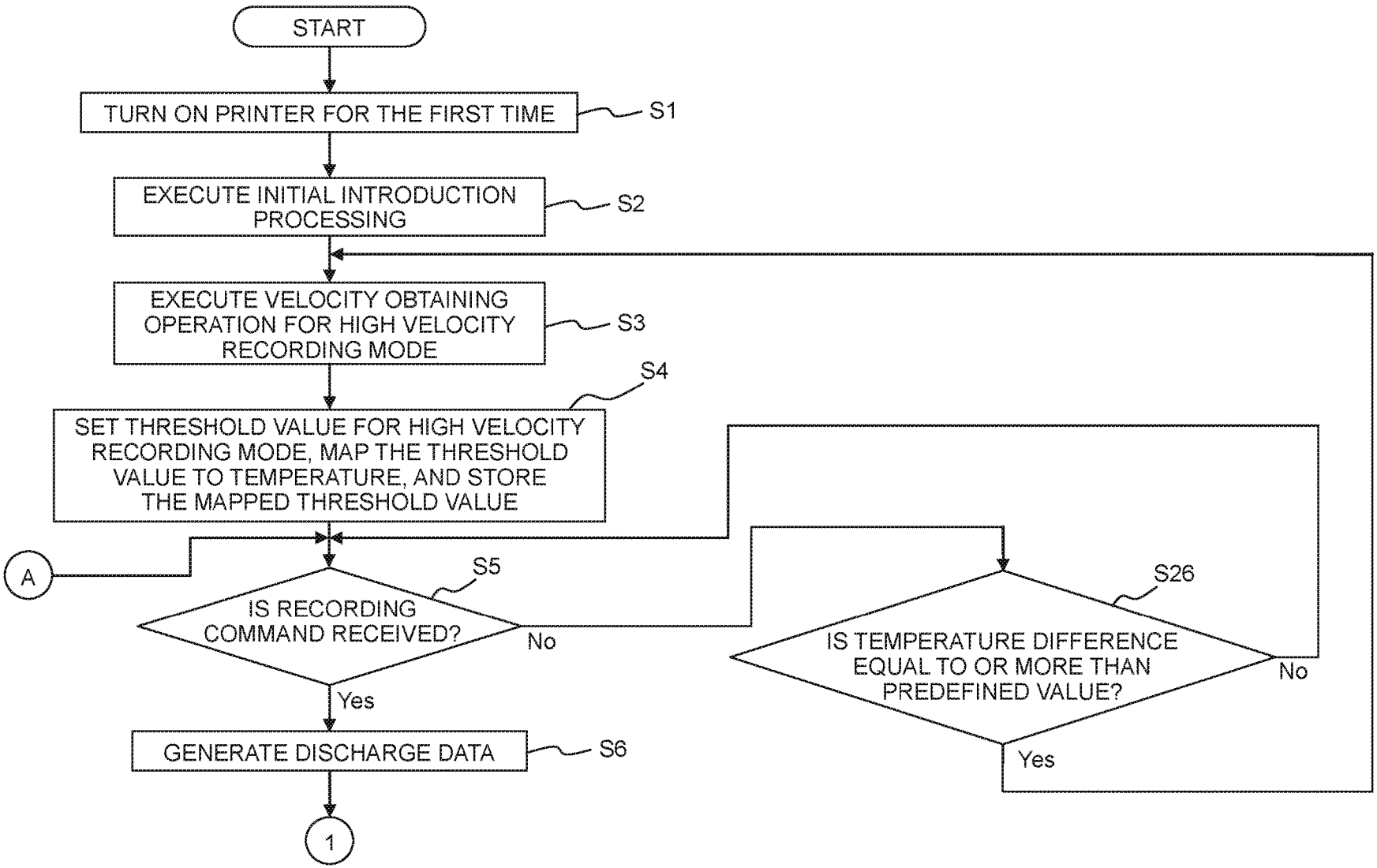
FIG. 6A, FIG. 6B, FIG. 6C and FIG. 6D depict a flowchart indicating operations of the ink-jet printer.
Figure 6B:
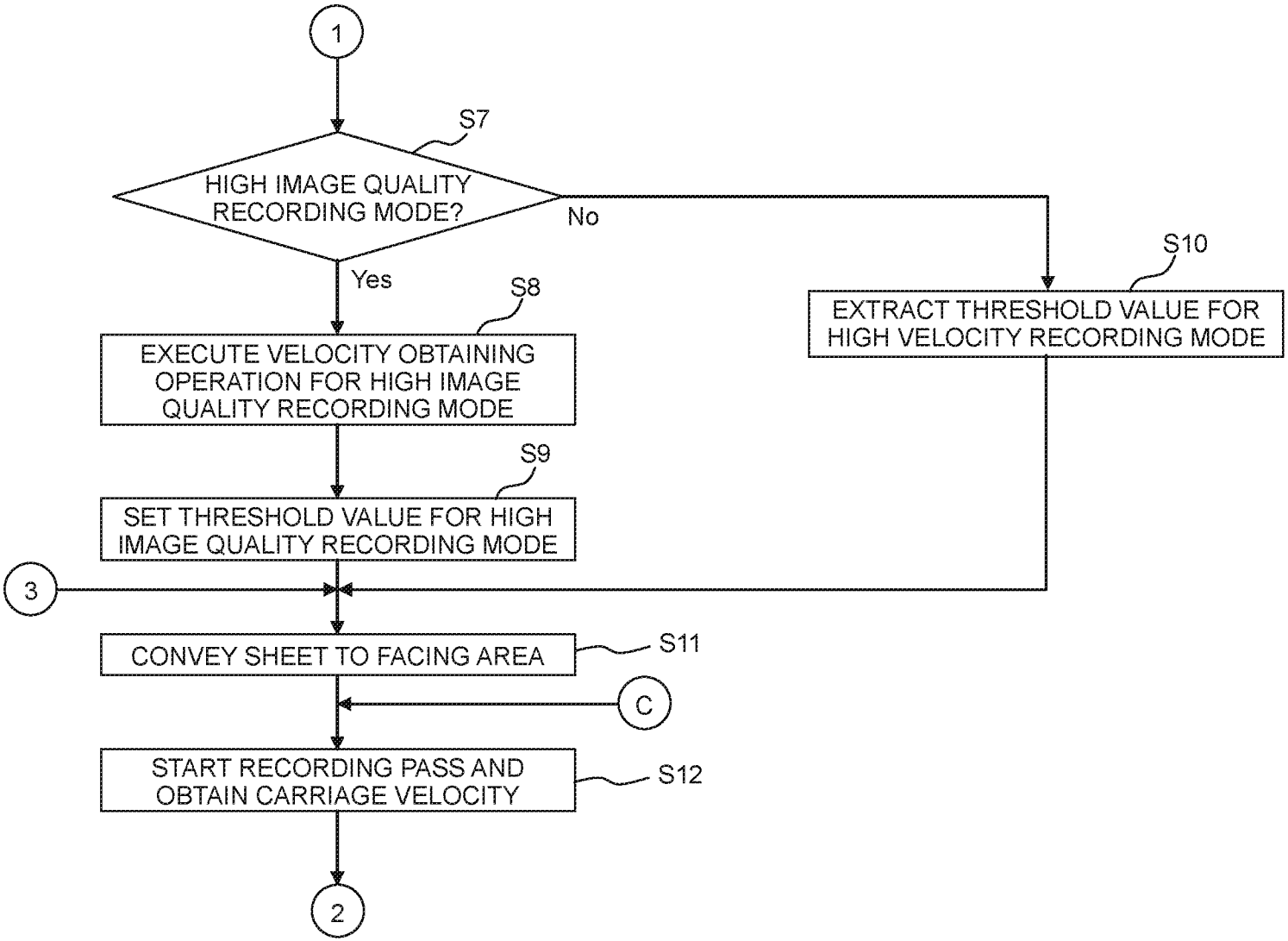
Figure 6C:
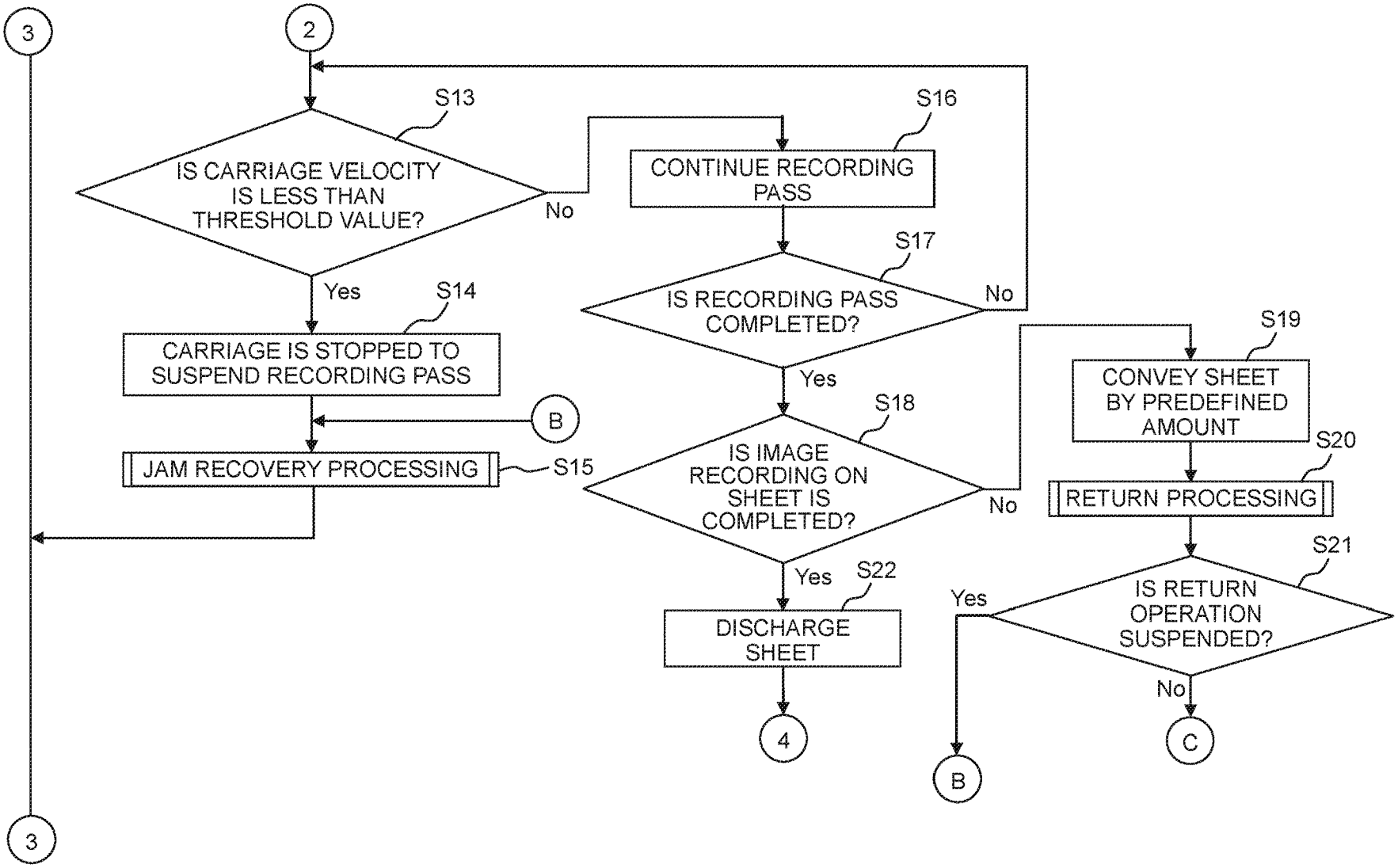
Figure 6D:
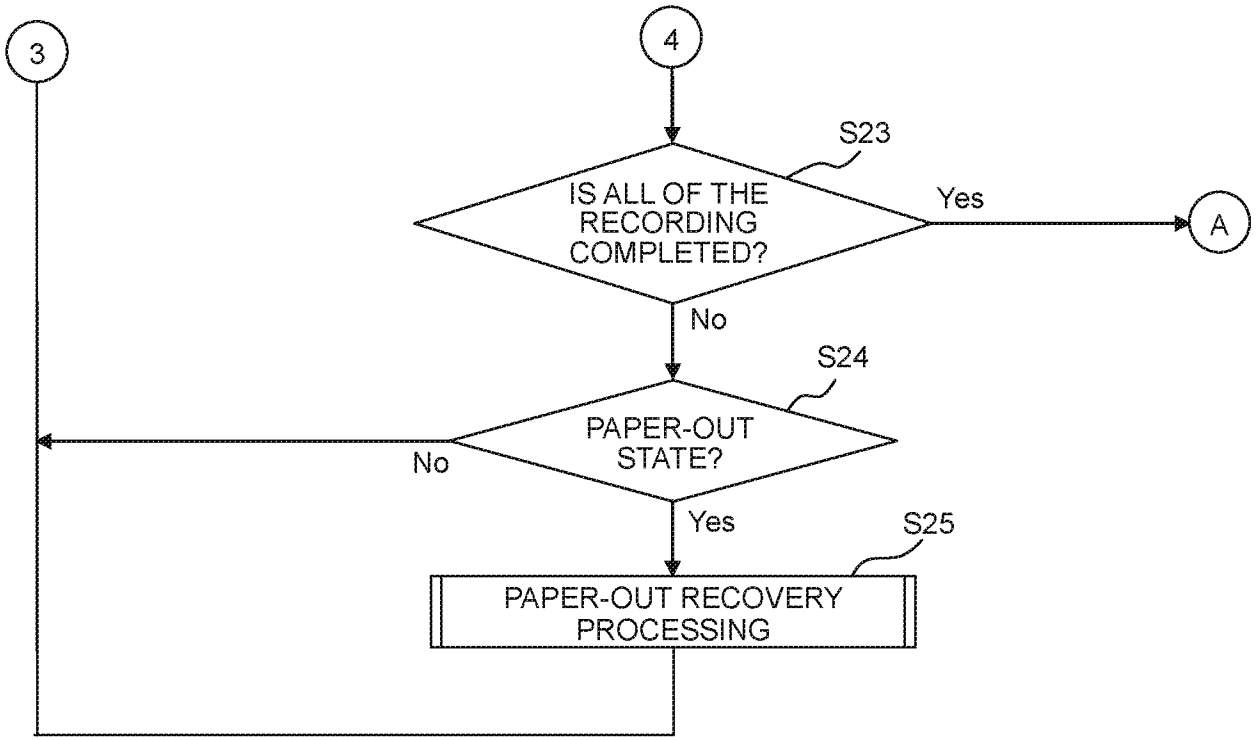

In the conveyance operation using the high image quality recording mode, the sheet P is conveyed by a second conveyance amount M2, which is an approximately half of the length L of each nozzle row 9. More specifically, the second conveyance amount M2 is represented by M2=(L/2) when the number of nozzles 10 forming each nozzle row 9 is an odd number. The second conveyance amount M2 is represented by M2=[(L/2)+(K/2)] or M2=[(L/2)−(K/2)] when the number of nozzles 10 forming each nozzle row 9 is an even number. As described above, a so-called interlaced image is recorded by using the high image quality recording mode. Thus, as depicted in FIG. 5C, of two recording areas Q where the image is recorded by two consecutive recording passes, a half of an upstream side in the conveyance direction of the recording area Q where the image is recorded by the preceding recording pass overlaps with a half of a downstream side in the conveyance direction of the recording area Q where the image is recorded by the succeeding recording pass.

The resolution in the scanning direction using the high image quality recording mode is higher than that using the high velocity recording mode. When the velocity of the carriage 4 of the high image quality recording mode is the same as that of the high velocity recording mode, the discharge period is shorter as the resolution in the scanning direction is higher. Thus, the high image quality recording mode may have the following problem. Namely, the next ink discharge timing comes after ink is discharged from a certain nozzle 10 until the certain nozzle 10 is ready to discharge ink. In the first embodiment, however, the high image quality recording mode has a target velocity of the carriage 4 in the recording pass that is slower than that of the high velocity recording mode. The high image quality recording mode of the first embodiment is thus not likely to have the above problem.

As described above, in the high image quality recording mode, the resolution in the conveyance direction and the resolution in the scanning directing are high and the target velocity of the carriage 4 in the recording pass is slow. Recording on the sheet P using the high image quality recording mode can thus result in a higher quality image than the high velocity recording mode. On the other hand, since the conveyance amount of the sheet P in the conveyance operation in the case of the high image quality recording mode is small, the number of the recording passes required for each sheet P increases. Further, the target velocity of the carriage 4 in the recording pass in the case of the high image quality recording mode is slow. The high image quality recording mode thus requires a recording time, during which an image based on a recording command is recorded, longer than that required in the high velocity recording mode. Namely, when the high image quality recording mode and the high velocity recording mode are used to record an image on the sheet P based on the same image data, the high image quality recording mode requires a longer recording time than the high velocity recording mode. Further, the resolution of the image recorded on the sheet P using the high image quality recording mode is higher than that using the high velocity recording mode. Thus, when the high image quality recording mode and the high velocity recording mode are used to record an image based on the same image data, the high image quality recording mode has a total discharge amount of ink(s) discharged from the head 5 that is larger than the high velocity recording mode.

The sheet P absorbing ink may be deformed such as cockling or curling. The cockling is wave-like wrinkles and the curling is deformation in which the sheet P entirely curves. Such sheet deformation may cause a jam of the sheet P by bringing the sheet P into contact with the nozzle surface 10*a* of the head 5 during movement of the carriage 4 in the subsequent recording pass. If movement of the carriage 4 continues with the jam being caused, the nozzle surface 10*a* of the head 5 would be damaged. This may cause discharge failure and/or worsen the jam.

In order to solve the above problem, it is possible to use a method of determining whether the jam is caused. In the method, the carriage velocity Vcr is obtained every time the carriage 4 moves in the recording pass, and the carriage velocity Vcr is compared to a predefined threshold value. Specifically, in the recording pass, the CPU 101 controls the carriage motor 16 to move the carriage 4 at the target velocity, as described above. Although the carriage 4 is slightly affected by motor fluctuation during that control, the carriage 4 moves at approximately the target velocity. In the case of the jam, however, the carriage velocity Vcr greatly decreases from the target velocity due to frictional force between the nozzle surface 10*a* and the sheet P. Thus, when the carriage velocity Vcr, which is obtained during the control on the carriage motor 16, is less than the predefined threshold value, the CPU 101 determines that the jam is caused.

As described above, when the CPU 101 has determined that the jam is caused, the movement of the carriage 4 is stopped to suspend the recording pass. This inhibits damage in the nozzle surface 10*a*, worsening of the jam, and the like. In order to improve the accuracy of determination whether the jam is caused, the threshold value is required to be an exact value depending on a use environment. Namely, if the threshold value is set as a fixed value irrespective of the use environment, the CPU 101 may erroneously determine that the jam is caused in a state where no jam is caused. Details thereof are explained below.

When the use environment of the printer 1 changes, such as the change in ambient temperature, the velocity of the carriage 4 changes. For example, a lubricant, such as grease, is interposed between the guide rails 11, 12 and the carriage 4 to reduce a sliding load of the carriage 4. Solidity or hardness of the lubricant depends on the ambient temperature. The change in ambient temperature thus changes the sliding load of the carriage 4, which changes the velocity of the carriage 4.

The head 5 carried on the carriage 4 is connected to the ink supply tubes 55. In that configuration, a driving load by the ink supply tubes 55 is applied on the carriage 4 during movement of the carriage 4. The hardness of the ink supply tubes 55 depends on the ambient temperature. The change in ambient temperature thus changes the driving load on the carriage 4, which changes the velocity of the carriage 4. When a surface condition of each sliding component, such as guide rails 11, 12 and the carriage 4, changes, the sliding load of the carriage 4 changes. The surface condition may change due to, for example, getting rusty and generation of dew condensation owing to a rapid temperature change. Regarding the motor, such as the carriage motor 16, output current and torque depend on the ambient temperature. The change in ambient temperature thus changes the stability of velocity of the carriage 4. As described above, the change in use environment changes the velocity of the carriage 4. When only the sliding load of the carriage 4 and the driving load by the ink supply tubes 55 are taken into consideration, the velocity of the carriage 4 typically decreases as the ambient temperature lowers.

The scale 21 may have failure, for example, when ink dirties a part of the scale 21. For example, when the jam is caused, a user removes the jammed sheet. During the removal process, ink may adhere to and dirt the scale 21. When the scale 21 has something wrong, such as dirt on the scale 21, the detection sensor 22 has difficulty reading the non-transmissive area 21*b* on the scale 21 accurately. This may make the carriage velocity Vcr obtained based on the detection result of the detection sensor 22 slower than an actual velocity.

For the reasons stated above, when the threshold value is set as the fixed value, the carriage velocity Vcr obtained based on the detection result of the detection sensor 22 may become lower than the threshold value even when no jam is caused. In view of the above, in the first embodiment, the threshold value is set through the following processing before image recording, without being set as the fixed value.

Specifically, the CPU 101 executes a velocity obtaining operation in which the carriage velocity Vcr is obtained multiple times based on the detection results of the detection sensor 22 while the carriage motor 16 is controlled to uniformly move the carriage 4 at the target velocity for the recording pass. The velocity obtaining operation is executed in a state where no sheet P is present in the facing area A. Then, the CPU 101 sets, as the threshold value, a value that is included in multiple carriage velocities Vcr obtained through the velocity obtaining operation and is slower, by a predefined amount, than the slowest carriage velocity Vcr. For example, the threshold value may be a value decreasing from the slowest carriage velocity Vcr by a small percent. Accordingly, it is possible to set an appropriate threshold value depending on the use environment, and the like. The high velocity recording mode and the high image quality recording mode have, for example, mutually different target velocities of the carriage 4 used for the recording pass. The velocity obtaining operation and the setting of the threshold value are thus executed for each of the high velocity recording mode and the high image quality recording mode.

In order to make the threshold value for the recording pass an exact value depending on the use environment and the like, the velocity obtaining operation is required to be executed after the recording command is received, and the threshold value is required to be set based on the velocity obtaining operation. Namely, in order to set the exact threshold value, the velocity obtaining operation is required to be executed after the recording command is received until the first recording pass is started. This period is hereinafter referred to as a warm-up time. However, when the velocity obtaining operation is executed in the warm-up time, a first print out time (FPOT) may lengthen.

Here, which one of making the threshold value exact and shortening the FPOT is given priority depends on characteristics of the respective recording modes. Specifically, a user typically selects the high velocity recording mode when the user gives priority to shortening the time after the recording command is received until image recording on the sheet P based on the recording command is completed over the image quality recorded on the sheet P. Thus, the high velocity recording mode should give priority to shortening the FPOT over making the threshold value exact.

When compared to the high velocity recording mode, it is not so important for the high image quality recording mode to shorten the time after the recording command is received until image recording on the sheet P based on the recording command is completed. Further, when compared to the high velocity recording mode, the high image quality recording mode has a larger discharge amount of ink discharged from the head 5 and a larger amount of ink landing on the sheet P. This easily deforms the sheet P. Further, the high image quality recording mode has a larger number of recording passes than the high velocity recording mode. Thus, when compared to the high velocity recording mode, the high image quality recording mode has a larger number of recording passes executed in a state where ink lands on the sheet P. Namely, the high image quality recording mode has a large number of recording passes executed in a state where the sheet P having ink landed thereon faces the head 5. The high image quality recording mode is thus more likely to get jammed during the recording pass than the high velocity recording mode. Therefore, the high image quality recording mode should give priority to making the threshold value exact over shortening the FPOT to enhance the accuracy of determination whether the jam is caused.

In view of the above, in the first embodiment, the velocity obtaining operation for the high image quality recording mode is executed in the warm-up time, which is a time after the recording command is received until the first recording pass is started (image recording is started). This makes the threshold value set based on the velocity data obtained through the velocity obtaining operation an exact value depending on the use environment, and the like. Meanwhile, the velocity obtaining operation for the high velocity recording mode is executed in any other time than the warm-up time. For example, the velocity obtaining operation for the high velocity recording mode is executed when the printer 1 is turned on for the first time. The threshold value is set based on the velocity data obtained through the velocity obtaining operation, and the threshold value set is stored in the threshold value table 104*a* in the non-volatile memory 104. When the recording processing using the high velocity recording mode is executed, the threshold value stored in the threshold value table 104 is extracted therefrom and used. In the high velocity recording mode, the velocity obtaining operation is not executed in the warm-up time, thus shortening the FPOT. In the first embodiment, only one threshold value, which is set based on velocity data obtained through the last velocity obtaining operation, is stored in the threshold value table 104*a*.

In the first embodiment, also in the return operation, the CPU 101 determines whether the jam is caused based on whether the carriage velocity Vcr is less than the predefined threshold value. The target velocity of the carriage 4 in each return operation is set by selecting any one of multiple levels of velocities depending on the movement range of the carriage 4 in the return operation. Namely, the target velocity of the carriage 4 in the return operation may be different from that in the recording pass. Further, respective return operations in the recording processing may have mutually different target velocities of the carriage 4. Thus, in order to enhance the accuracy of determination whether the jam is caused in the return operation, the velocity obtaining operation and the setting of the threshold value are required to be executed for each target velocity of the carriage 4 usable for the return operation. However, when the velocity obtaining operation is executed for each target velocity usable for the return operation, the velocity obtaining operation takes a long time. Especially, if the high image quality recording mode is selected and if the velocity obtaining operation for the return operation is executed in the warm-up time, the FPOT would be long. Further, a target velocity that is not actually used may be included in multiple levels of target velocities usable for the return operation, depending on content of an image to be recorded on the sheet P. Thus, when taking the above problem, such as the problem the FPOT is lengthened, into consideration, it is not necessarily effective to execute the velocity obtaining operation for the target velocity that may be not actually used, for the purpose of making the threshold value to be used in the return operation exact.

In view of the above, in the return operation, the CPU 101 determines whether the jam is caused based on whether the carriage velocity Vcr is lower than a threshold value determined based on the target velocity of the carriage 4. In the first embodiment, the threshold value used in the return operation is set to a value that is 85% of the target velocity of the carriage 4. Although the accuracy of determination whether the jam is caused is lower than the case in which the threshold value is set through the velocity obtaining operation, the FPOT is inhibited from lengthening.

Referring to FIG. 6, a series of operations of the printer 1 is explained. It is assumed that no sheet P is present in the feed route F and the conveyance route R when the flowchart in FIG. 6 starts.

As depicted in FIG. 6, when the printer 1 is turned on for the first time (S1), the CPU 101 causes the purge apparatus 30 to execute a suction purge. Then, the CPU 101 executes initial introduction processing for introducing ink in each ink cartridge 50 into the head 5 (S2). Next, the CPU 101 executes the velocity obtaining operation for the high velocity recording mode (S3). Specifically, the CPU 101 controls the carriage motor 16 to uniformly move the carriage 4 at the target velocity of the carriage 4 in the recording pass using the high velocity recording mode, and obtains the carriage velocity Vcr multiple times based on the detection results of the detection sensor 22 during movement of the carriage 4. Next, the CPU 101 selects a value that is included in multiple carriage velocities Vcr obtained above and is slower than the slowest carriage velocity Vcr by a predefined amount, and sets the selected value as the threshold value for the high velocity recording mode. Then, the CPU 101 maps the value set as the threshold value to a temperature measured by the temperature sensor 98 in the step S3, and stores the mapped value in the threshold value 104*a* of the non-volatile memory 104 (S4).

After that, the CPU 101 determines whether to receive a recording command from the external apparatus 200, or the like (S5). When the CPU 101 has determined that the recording command is received (S5: YES), the CPU 101 generates the discharge data ED in accordance with the recording command based on image data to be recorded that is stored in the RAM 103 (S6). Then, the CPU 101 determines which one of the high image quality recording mode and the high velocity recording mode is designated by the recording command (S7). When the CPU 101 has determined that the high image quality recording mode is designated by the recording command (S7: YES), the CPU 101 executes the velocity obtaining operation for the high image quality recording mode (S8). Specifically, the CPU 101 controls the carriage motor 16 to uniformly move the carriage 4 at the target velocity of the carriage 4 in the recording pass using the high image quality recording mode, and obtains the carriage velocity Vcr multiple times based on the detection results of the detection sensor 22 during movement of the carriage 4. Next, the CPU 101 selects a value that is included in multiple carriage velocities Vcr obtained above and is slower than the slowest carriage velocity Vcr by a predefined amount, and sets the selected value as the threshold value for the high image quality recording mode (S9). Upon completing the processing in the step S9, the CPU 101 returns to the step S11.

When the CPU 101 has determined in the step S7 that the high velocity recording mode is designated (S7: NO), the CPU 101 extracts the threshold value from the threshold value table 104*a* stored in the non-volatile memory 104 (S10) and returns to the step S11.

In the step S11, the CPU 101 controls the pickup roller 52, the conveyance motor 45, and the like to convey the sheet P in the feed tray 51 to the facing area A. Then, the CPU 101 starts one recording pass (S12). Namely, the CPU 101 controls the carriage motor 16 to move the carriage 4 in the scanning direction and controls the head 5 based on the discharge data ED generated in the step S6 to discharge ink from each nozzle 10. During the control on the carriage motor 16, the carriage velocity Vcr is obtained based on every detection result of the detection sensor 22.

Next, the CPU 101 determines whether the carriage velocity Vcr currently obtained is less than the threshold value (S13). When the high image quality recording mode is used, a threshold value to be compared with the carriage velocity Vcr is set as the threshold value for the high image quality recording mode set in the step S9. When the high velocity recording mode is used, the threshold value to be compared with the carriage velocity Vcr is set as the threshold value extracted in the step S10.

When the CPU 101 has determined that the carriage velocity Vcr is less than the threshold value (S13: YES), the CPU 101 determines that the jam is caused, controls the carriage motor 16 to stop movement of the carriage 4, and suspends the recording pass (S14). Then, the CPU 101 executes jam recovery processing explained below with reference to FIG. 7A (S15). In the jam recovery processing, a user removes the jammed sheet P from the printer 1. After the step S15, the CPU 101 returns to the step S11 to restart the recording pass.

When the CPU 101 has determined in the step S13 that the carriage velocity Vcr is equal to or more than the threshold value (S13: NO), the CPU 101 determines that no jam is caused and continues the recording pass (S16). Then, the CPU 101 determines whether the recording pass (image recording corresponding to one pass) is completed (S17). When the CPU 101 has determined that the recording pass is not yet completed (S17: NO), the CPU 101 returns to the step S13 to continue the recording pass. When the CPU 101 has determined that the recording pass is completed (S17: YES), the CPU 101 determines whether image recording on the sheet P is completed (S18). When the CPU 101 has determined that image recording on the sheet P is not yet completed (S18: NO), the CPU 101 controls the conveyance motor 45 to convey the sheet P frontward by a predefined amount (S19) and executes return processing explained blow with reference to FIG. 7B (S20). In the return processing, the CPU 101 executes, for example, a return operation of the carriage 4.

Subsequently, the CPU 101 determines (S21) whether the return operation of the carriage 4 is suspended in the return processing executed in the step S20. When the CPU 101 has determined that the return operation is not suspended (S21: NO), the CPU 101 proceeds to the step S12 to execute the next recording pass. When the CPU 101 has determined that the return operation is suspended (S21: YES), the CPU 101 proceeds to the step S15 to execute the jam recovery processing.

When the CPU 101 has determined in the step S18 that image recording on the sheet P is completed (S18: YES), the CPU 101 controls the conveyance motor 45 to discharge the sheet P, for which recording is performed, on the discharge tray 54 (S22). After that, the CPU 101 determines whether all of the image recording based on the recording command received is completed (S23). When the CPU 101 has determined that all of the image recording is completed (S23: YES), the CPU 101 returns to the step S5. When the CPU 101 has determined that all of the image recording is not yet completed (S23: NO), the CPU 101 determines based on the detection result of the remaining sheet detection sensor 56 whether the feed tray 51 is in a paper-out state (S24). When the CPU 101 has determined that the feed tray 51 is not in the paper-out state (S24: NO), the CPU 101 proceeds to the step S11 to execute image recording on the next sheet P. When the CPU 101 has determined that the feed tray 51 is in the paper-out state (S24: YES), the CPU 101 executes paper-out recovery processing explained below with reference to FIG. 7C (S25). In the paper-out recovery processing, a user supplies the feed tray 51 with sheets P. After completing the step S25, the CPU 101 proceeds to the step S11 to execute image recording on the next sheet P.

When the CPU 101 has determined in the step S5 that no recording command is received (S5: NO), the CPU 101 determines whether a difference between a current temperature measured by the temperature sensor 98 and the temperature that is mapped to the threshold value and is stored in the threshold value table 104*a* is equal to or more than a predefined value (S26). When the CPU 101 has determined that the difference in temperatures is less than the predefined value (S26: NO), the CPU 101 returns to the step S5. When the CPU 101 has determined that the difference in temperatures is equal to or more than the predefined value (S26: YES), the CPU 101 returns to the step S3 to execute the velocity obtaining operation for the high velocity recording mode and to set the threshold value again. This makes the threshold value for the high velocity recording mode stored in the threshold value table 104*a* an appropriate value depending on the environment in which the printer 1 is currently used.

Figure 7A:
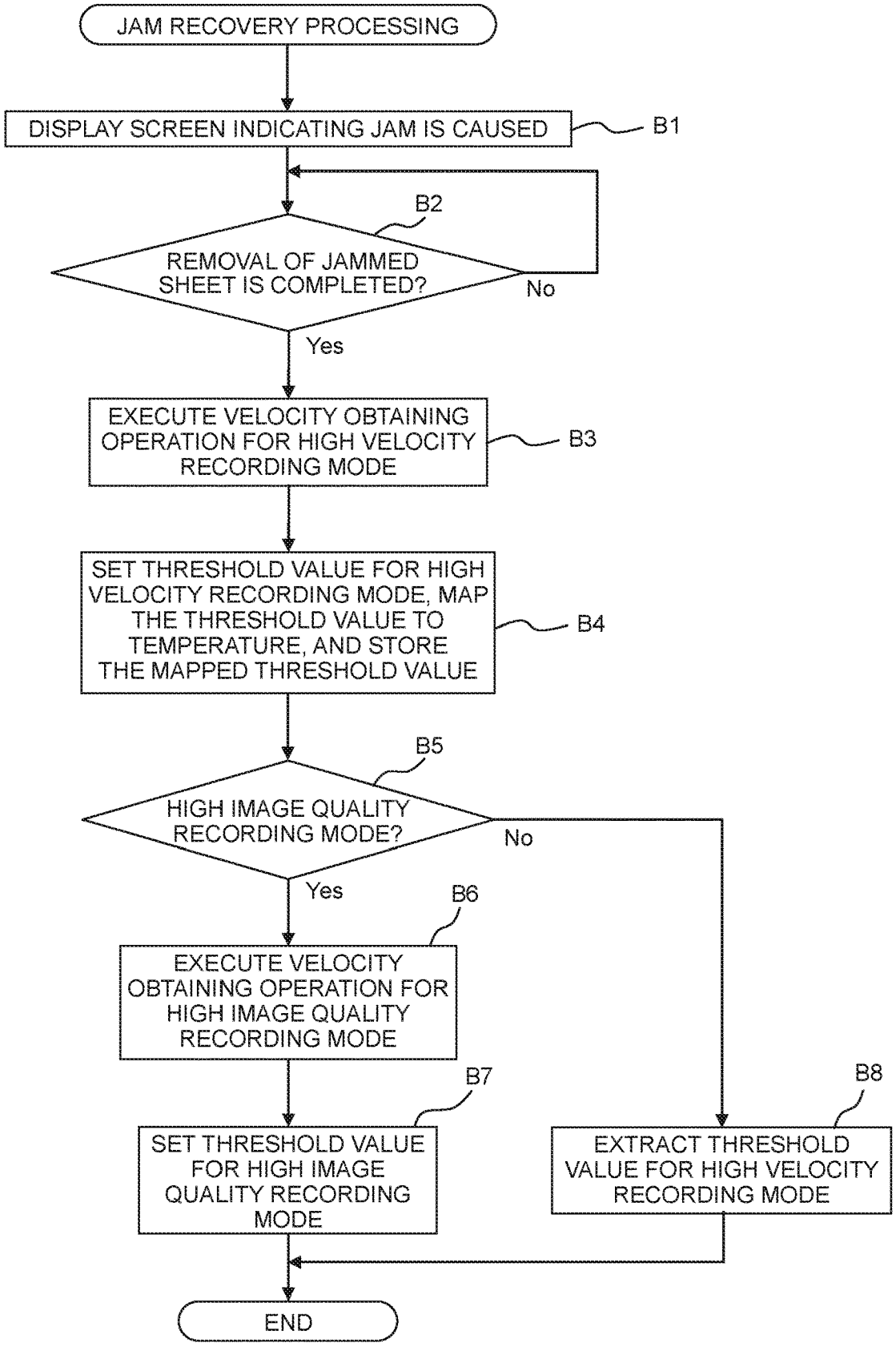
FIG. 7A is a flowchart of jam recovery processing.

Next, referring to FIG. 7A, the jam recovery processing is explained. At first, the CPU 101 displays, on the touch panel 99, a screen indicating that the jam is caused (B1). Then, a user removes the jammed sheet P from the printer 1. When the CPU 101 has received, via the touch panel 99, input indicating that a user successfully removed the jammed sheet P (B2: YES), the CPU 101 executes processing in steps B3 and B4 similar to the processing in the steps S3 and S4. This makes the threshold value for the high velocity recording mode stored in the threshold value table 104*a* an appropriate value depending on, for example, the environment in which the printer 1 is currently used.

Next, the CPU 101 determines which one of the high image quality recording mode and the high velocity recording mode is used in the recording processing currently executed (B5). When the CPU 101 has determined that the high image quality recording mode is used (B5: YES), the CPU 101 executes processing in steps B6 and B7 similar to the processing in the steps S8 and S9. This makes the threshold value for the high image quality recording mode an appropriate value depending on, for example, the environment in which the printer 1 is currently used, thus improving the accuracy of determination whether the jam is caused in the subsequent recording passes. When the CPU 101 has determined that the high velocity recording mode is used (B5: NO), the CPU 101 extracts the threshold value stored in the threshold value table 104*a* as a threshold value to be used for the subsequent recording passes (B8). Then, the CPU 101 ends this processing. The jam recovery processing as described above makes the threshold value for the high velocity recording mode stored in the threshold value table 104*a* an exact value even when the scale 21 has new dirt through removal of the jammed sheet P. Further, it is possible to make the threshold value used for the recording mode in the recording process currently executed an exact value.

Figure 7B:
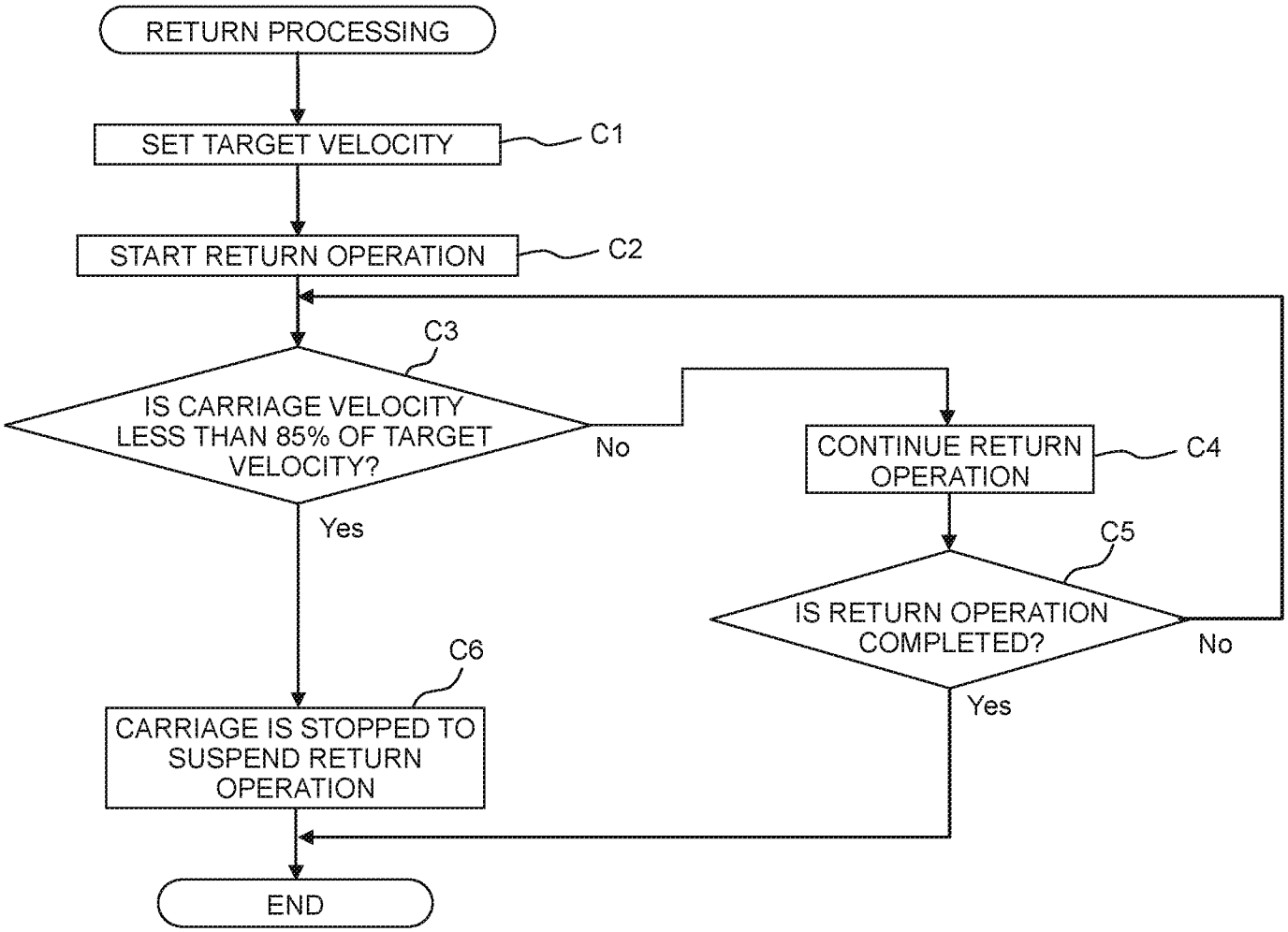
FIG. 7B is a flowchart of return processing.

Referring to FIG. 7B, the return processing is explained below. The CPU 101 selects any one of multiple levels of velocities usable for the return operation, as the target velocity, depending on the movement range of the carriage 4 in the current return operation (C1). Then, the CPU 101 executes the return operation by controlling the carriage motor 16 to uniformly move the carriage 4 leftward at the target velocity set as above. During the control on the carriage motor 16, the carriage velocity Vcr is obtained based on every detection result of the detection sensor 22.

Subsequently, the CPU 101 determines whether the carriage velocity Vcr currently obtained is less than 85% of the target velocity set in the step C1 (C3). When the CPU 101 has determined that the carriage velocity Vcr is equal to or more than 85% of the target velocity (C3: NO), the CPU 101 determines that no jam is caused and continues the return operation (C4). Then, the CPU 101 determines whether the return operation is completed (C5). When the CPU 101 has determined that the return operation is not completed (C5: NO), the CPU 101 returns to the step C3. When the CPU 101 has determined that the return operation is completed (C5: YES), the CPU 101 ends this processing.

When the CPU 101 has determined in the step C3 that the carriage velocity Vcr is less than 85% of the target velocity, the CPU 101 determines that the jam is caused, controls the carriage motor 16 to stop movement of the carriage 4, and suspends the return operation (C6). After completing the step C6, the CPU 101 ends this processing.

Figure 7C:
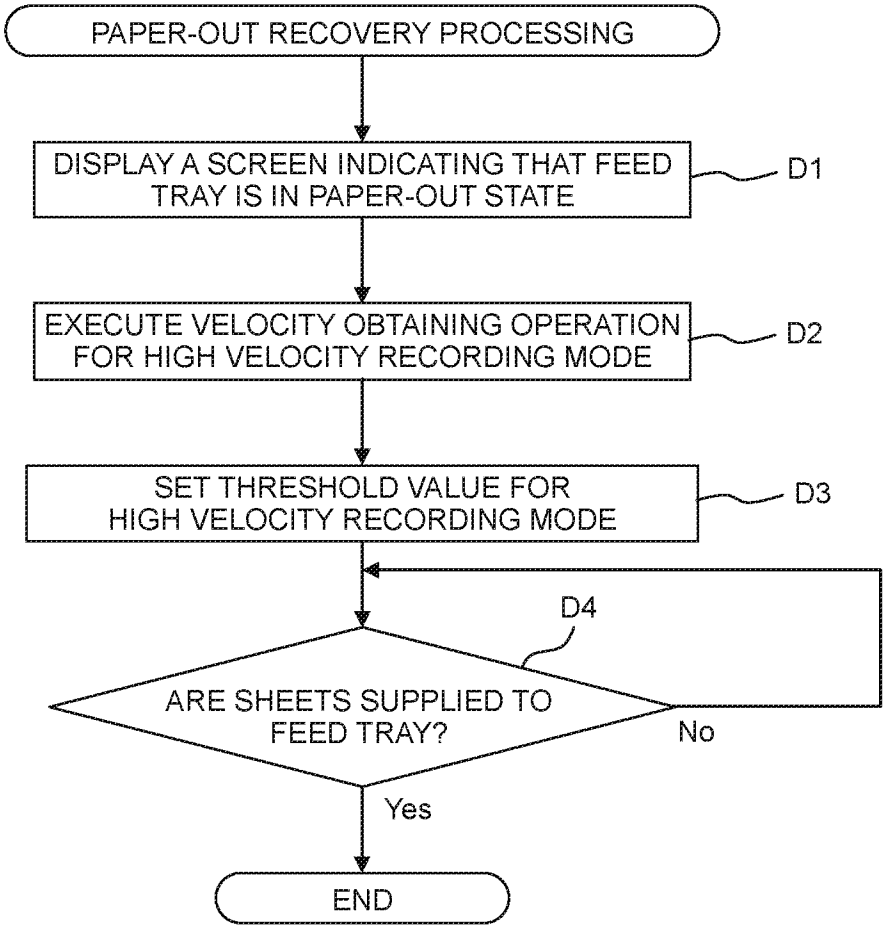
FIG. 7C is a flowchart of paper-out recovery processing.
Figure 8A:
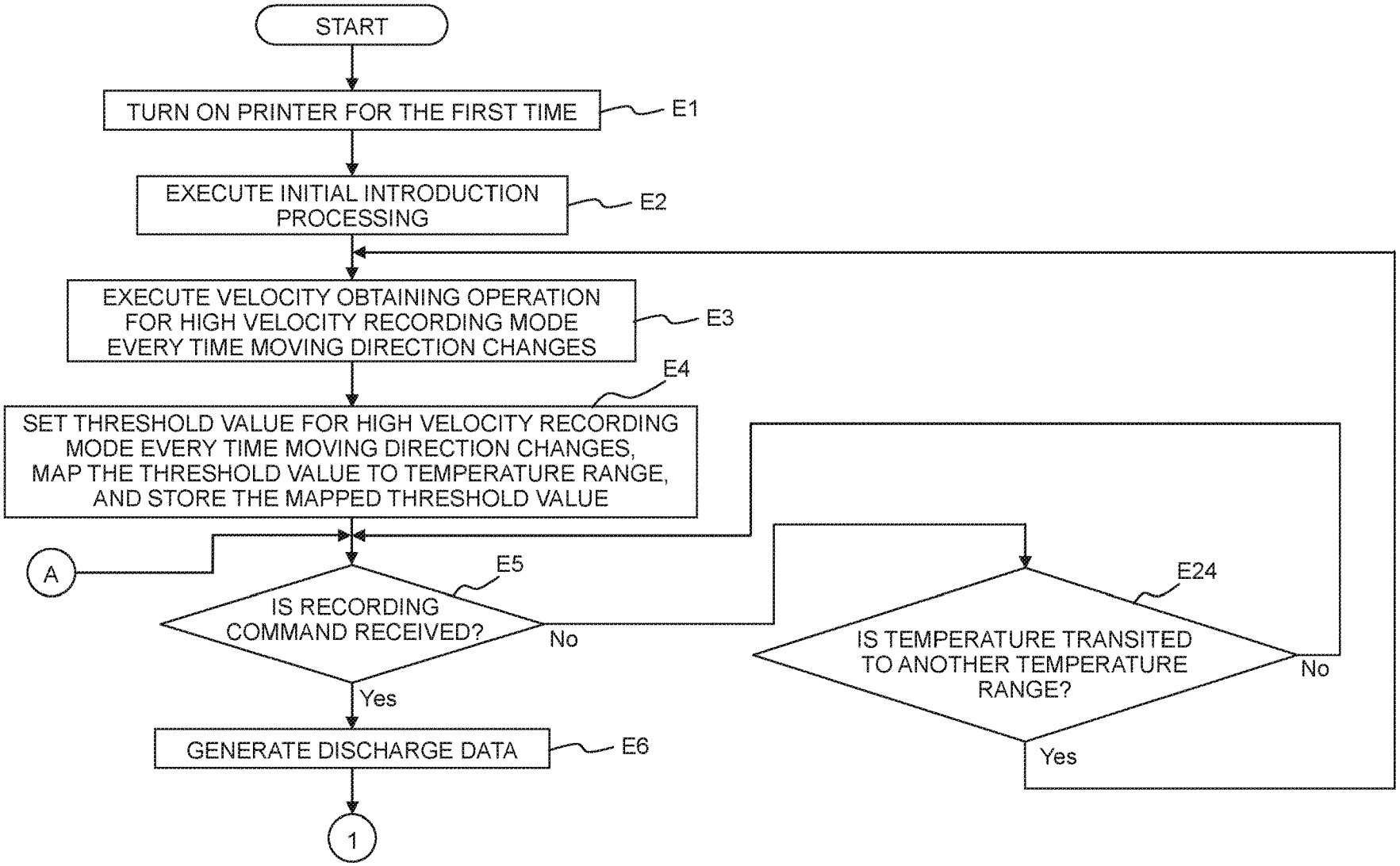
FIG. 8A, FIG. 8B, FIG. 8C and FIG. 8D depict a flowchart of operations of the ink-jet printer according to the second embodiment.
Figure 8B:
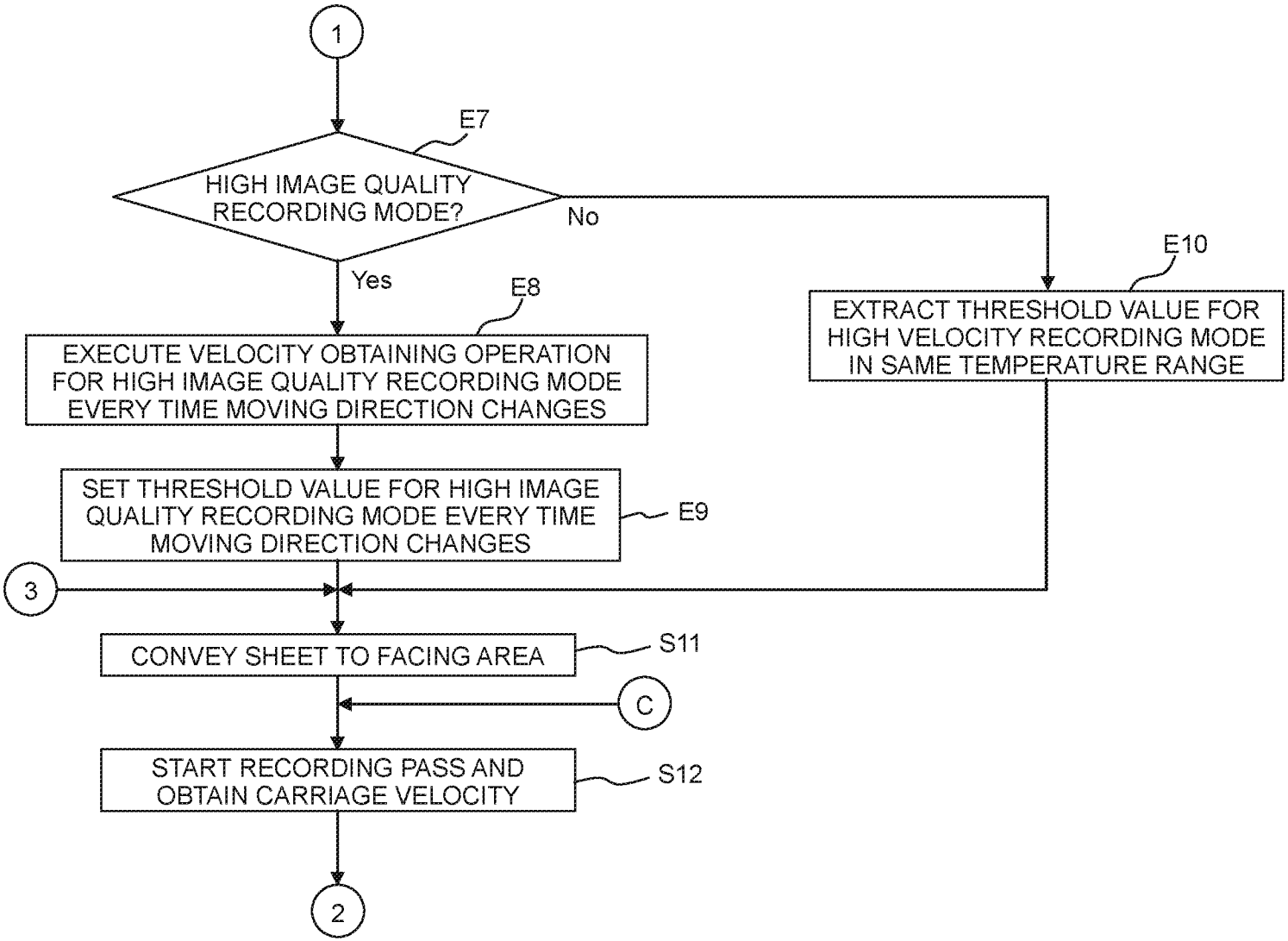
Figure 8C:
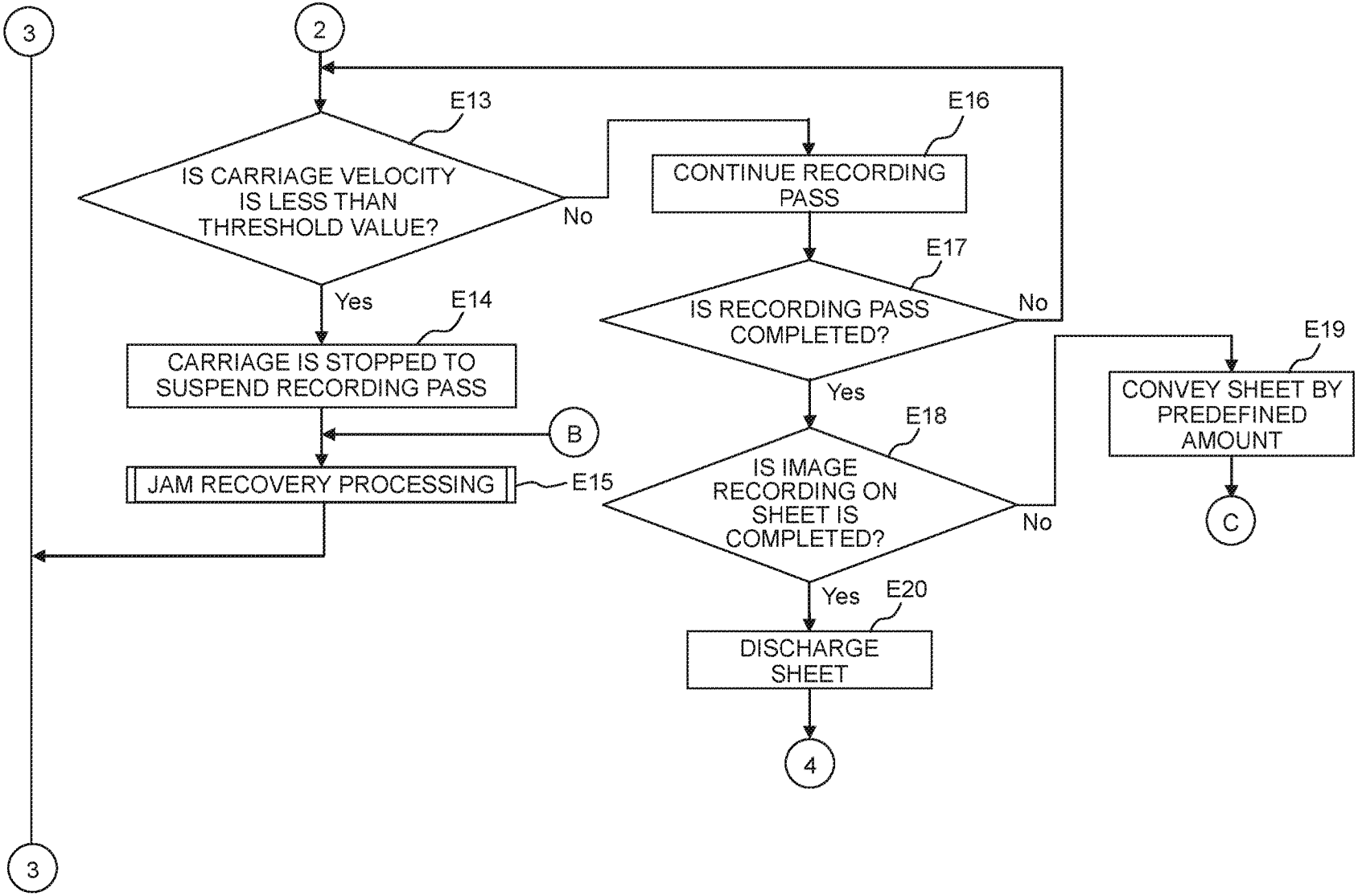
Figure 8D:
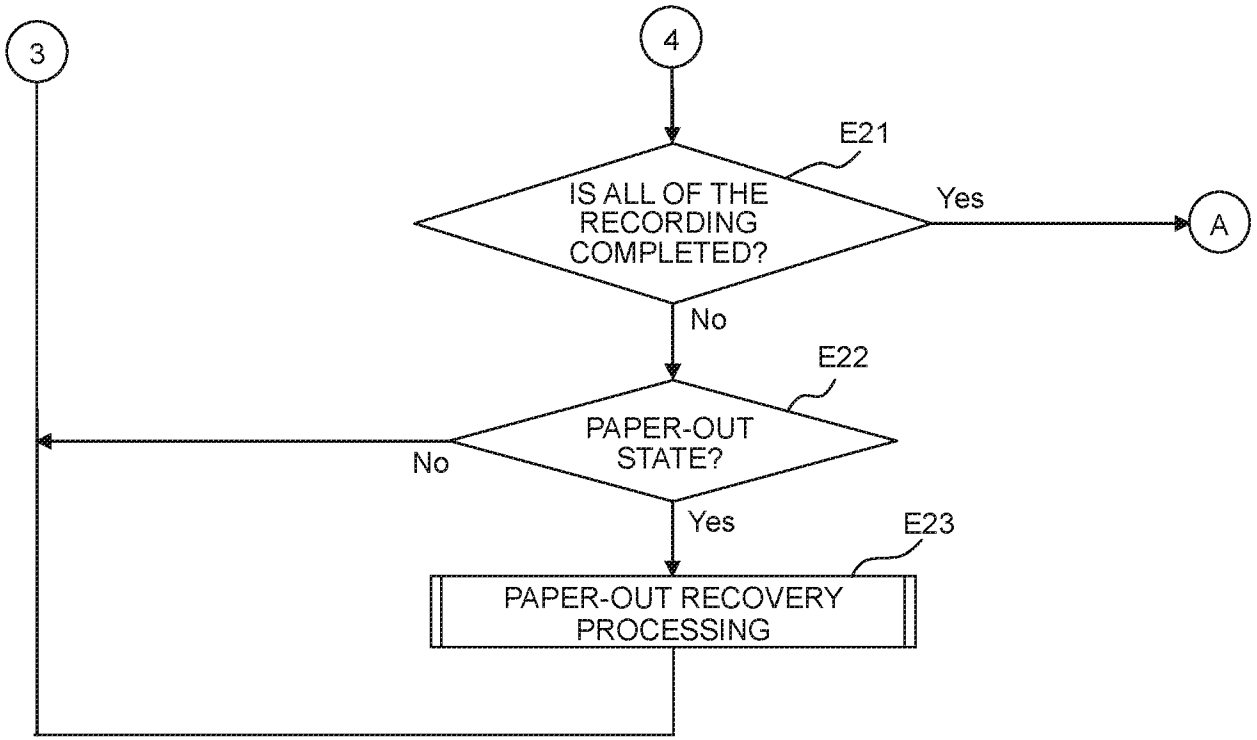
Figure 9A:
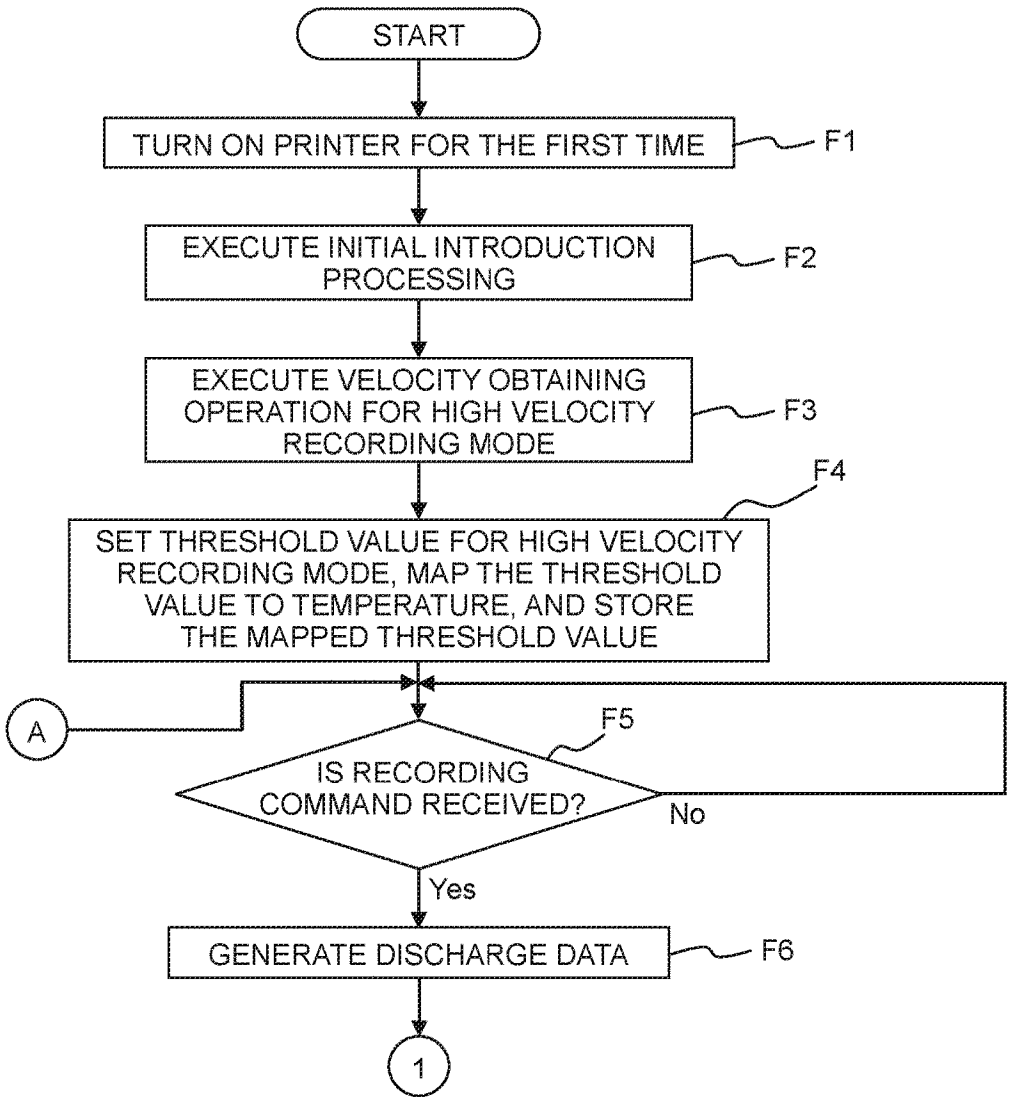
FIG. 9A, FIG. 9B, FIG. 9C and FIG. 9D depict a flowchart of operations of the ink-jet printer according to the third embodiment.
Figure 9B:
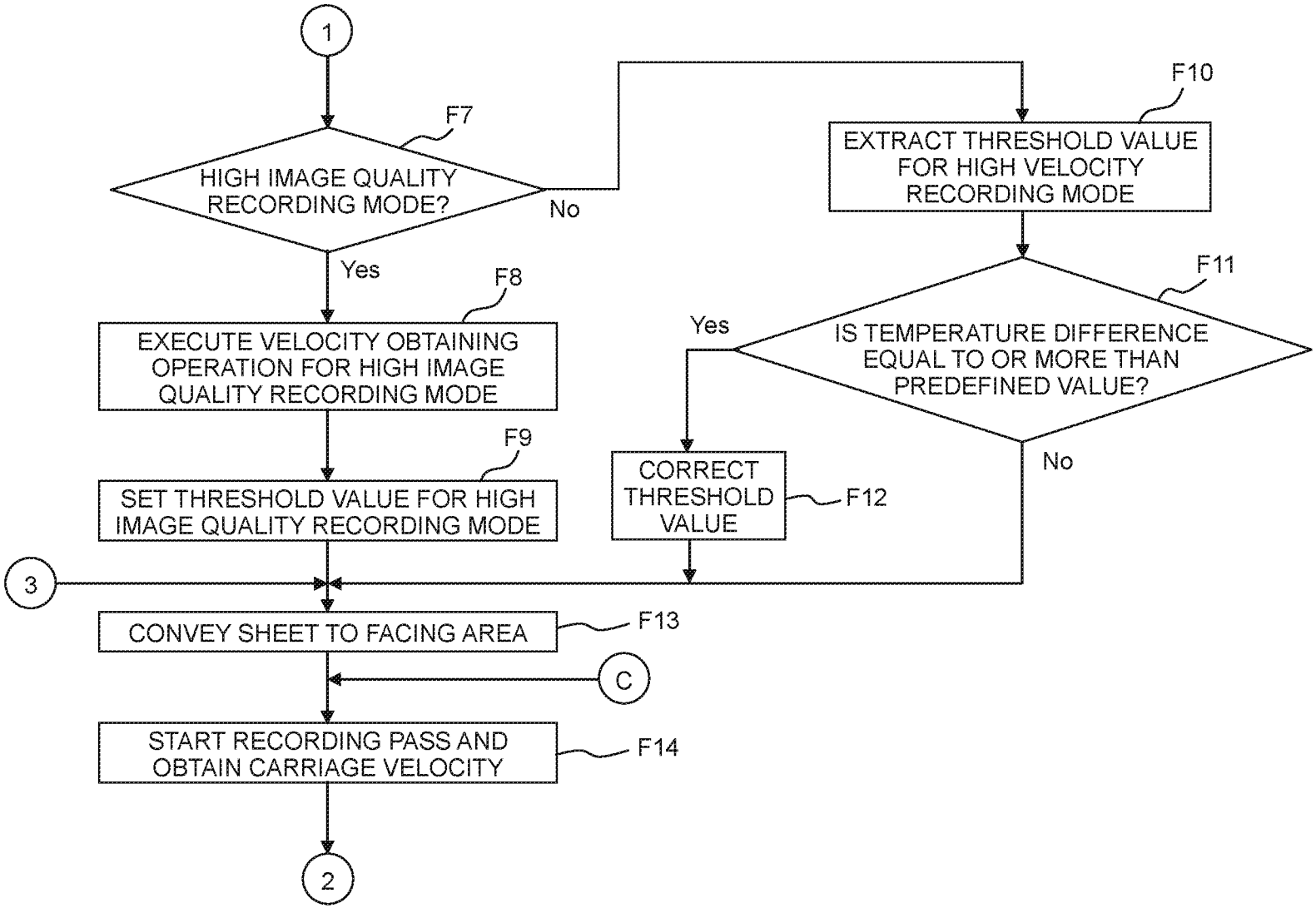
Figure 9C:
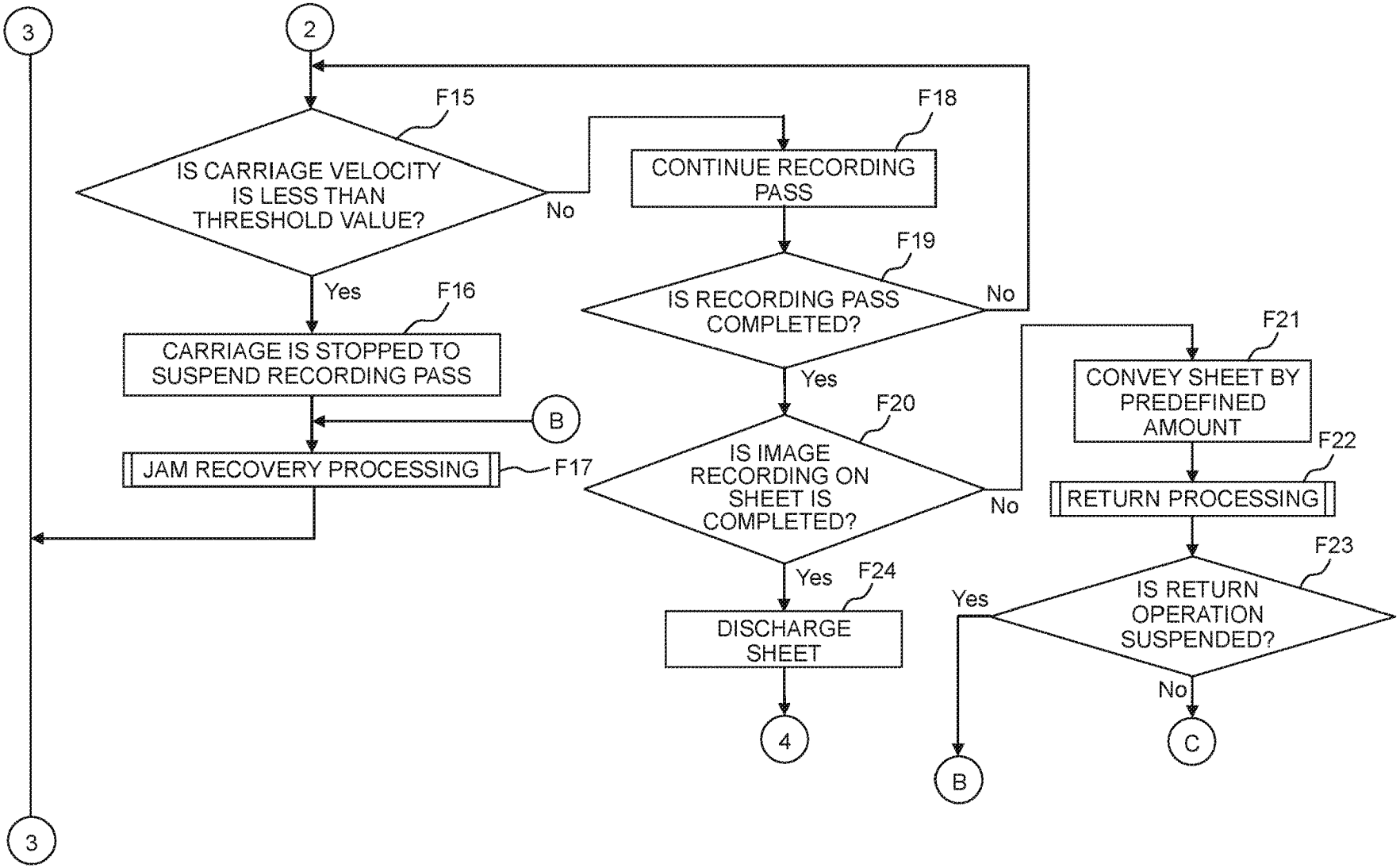
Figure 9D:
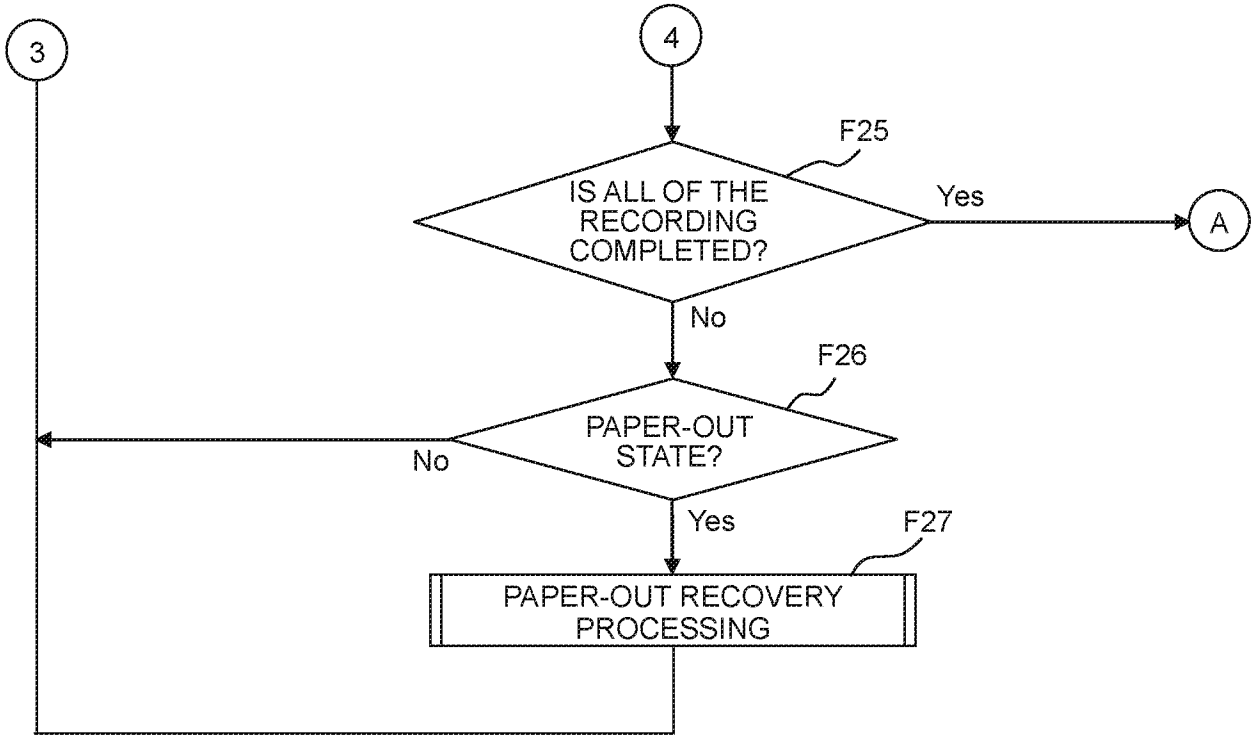

Referring to FIG. 7C, the paper-out recovery processing is explained. The CPU 101 suspends the recording processing and displays, on the touch panel 9, a screen indicating that a user needs to supply the feed tray 51 with sheets P (D1). Then, the CPU 101 executes processing in steps D2 and D3 similar to the processing in the steps S3 and S4. This makes the threshold value for the high velocity recording mode stored in the threshold value table 104*a* an appropriate value depending on, for example, the environment in which the printer 1 is currently used. When the CPU 101 has determined based on the detection result of the remaining sheet detection sensor 56 that the feed tray 51 is successfully supplied with sheets P (D4: YES), the CPU 101 ends this processing and restarts the recording processing.

According to the first embodiment, the velocity obtaining operation for the high image quality recording mode is executed in the warm-up time, which is a time period after the recording command is received until image recording is started. This allows the threshold value for the high image quality recording mode to be set accurately. Meanwhile, the velocity obtaining operation for the high velocity recording mode is executed in any other time than the warm-up time. Since the high velocity recording mode can shorten the time after the recording command is received until image recording is started, the FPOT can also be shortened.

The velocity obtaining operation for the high velocity recording mode is executed when the printer 1 is turned on for the first time. Here, when the printer 1 is turned on for the first time, processing that needs a long time, such as the initial introduction processing, is executed. Thus, executing the velocity obtaining operation for the high velocity recording mode when the printer 1 is turned on for the first time makes the threshold value for the high velocity recording mode an exact value depending on the use environment without affecting usability of the printer 1. In the first embodiment, the velocity obtaining operation for the high velocity recording mode is executed in a time after the recording processing is suspended due to the paper-out state until the recording processing is restarted, which is efficient. It is thus possible to make the threshold value for the high velocity recording mode an exact value depending on the use environment without affecting usability of the printer 1.

Second Embodiment

A second embodiment is explained below. In the second embodiment, bidirectional recording is used to record an image, wherein the recording pass is executed both when the carriage 4 moves toward one side (rightward) in the scanning direction and when the carriage 4 moves toward the other side (leftward) in the scanning direction. Thus, in the second embodiment, the return operation is not executed between two consecutive recording passes. Here, for example, the driving load on the carriage 4 during rightward movement of the carriage 4 may be different from that during leftward movement of the carriage 4. As described above, for example, the ink supply tubes 55 extend leftward from the connection portion with the head 5, turn to change the extending direction on the left of the head 5, extend rightward, and are connected to the holder 6. In that configuration, the load from the ink supply tubes 55 when the carriage 4 moves from the left end to the right end in the scanning direction of the movement range is different from that when the carriage 4 moves from the right end to the left end in the scanning direction of the movement range. Thus, even though the target velocity during rightward movement of the carriage 4 is the same as that during leftward movement of the carriage 4, the velocity of the carriage 4 during rightward movement of the carriage 4 may be different from that during leftward movement of the carriage 4. In view of the above, in the second embodiment, the velocity obtaining operation and the setting of the threshold value for each of the high image quality recording mode and the high velocity recording mode are executed every time the moving direction of the carriage 4 changes. Namely, the velocity obtaining operation and the setting of the threshold value are executed both when the carriage 4 moves rightward and when the carriage 4 moves leftward.

In the second embodiment, as depicted in FIG. 4C, the temperature measured by the temperature sensor 98 belongs to any of multiple temperature ranges and the threshold value table 104*a* of the non-volatile memory 104 stores threshold values corresponding to the respective temperature ranges. When the velocity obtaining operation and the setting of the threshold value for the high velocity recording mode are executed, the CPU 101 maps the threshold value set as above to a temperature range to which the temperature measured by the temperature sensor 98 in the velocity obtaining operation belongs, and stores the mapped threshold value in the non-volatile memory 104. When the recording processing is executed using the high velocity recording mode, the CPU 101 uses the threshold value that is stored in the threshold value table 104*a* while being mapped to the temperature range to which the current temperature measured by the temperature sensor 98 belongs. In the following, the parts or components that are the same as or equivalent to those of the first embodiment are designated by the same reference numerals, any explanation of which is omitted as appropriate.

Referring to FIG. 8, a series of operations of the printer 1 according to the second embodiment is explained.

As depicted in FIG. 8, the CPU 101 executes processing in steps E1 and E2 similar to the processing in the steps S1 and S2. Then, the CPU 101 executes the velocity obtaining operation for the high velocity recording mode both when the carriage 4 moves rightward and when the carriage moves leftward (E3). Namely, the CPU 101 executes the velocity obtaining operation in which the carriage 4 uniformly moves rightward at the target velocity in the recording pass using the high velocity recording mode and the velocity obtaining operation in which the carriage 4 uniformly moves leftward at the target velocity in the recording pass using the high velocity recording mode. Next, the CPU 101 sets, based on the velocity obtaining operation for the high velocity recording mode during rightward or leftward movement of the carriage 4, the threshold value for the high velocity recording mode for each of the case where the carriage 4 moves rightward and the case where the carriage 4 moves leftward. Then, the CPU 101 maps the threshold value to a temperature range to which the temperature measured by the temperature sensor 98 in the step E3 belongs, and stores the mapped threshold value in the threshold value table 104*a* (E4).

After that, the CPU 101 executes processing in steps E5 to E7 similar to the processing in the steps S5 to S7. When the CPU 101 has determined in the step E7 that the high image quality recording mode is designated by the recording command (E7: YES), the CPU 101 executes the velocity obtaining operation for the high image quality recording mode both when the carriage 4 moves rightward and when the carriage 4 moves leftward (E8). Namely, the CPU 101 executes the velocity obtaining operation in which the carriage 4 uniformly moves rightward at the target velocity in the recording pass using the high image quality recording mode and the velocity obtaining operation in which the carriage 4 uniformly moves leftward at the target velocity in the recording pass using the high image quality recording mode. Next, the CPU 101 sets, based on the velocity obtaining operation for the high image quality recording mode during rightward movement of the carriage 4, the threshold value for the high image quality recording mode for the case where the carriage 4 moves rightward (E9). Similarly, the CPU 101 sets, based on the velocity obtaining operation for the high image quality recording mode during leftward movement of the carriage 4, the threshold value for the high image quality recording mode for the case where the carriage 4 moves leftward (E9). After completing the processing in the step E9, the CPU 101 returns to the processing in the step E11.

When the CPU 101 has determined in the step E7 that the high velocity recording mode is designated by the recording command (E7: NO), the CPU 101 extracts, as the threshold value used for the recording processing using the current high velocity recording mode, the threshold value that is stored in the threshold value table 104*a* while being mapped to the temperature range to which the current temperature measured by the temperature sensor 98 belongs (E10). After completing the step E10, the CPU 101 proceeds to the step E11.

After that, the CPU 101 executes processing in steps E11 and E12 similar to the processing in the steps in S11 and S12. Then, the CPU 101 determines whether the carriage velocity Vcr currently obtained is less than the threshold value (E13). Specifically, when the high image quality recording mode is used, a threshold value that is included in the threshold values for the high image quality recording mode set in the step E9 and corresponds to the current moving direction of the carriage 4 is set as a threshold value to be compared with the carriage velocity Vcr. When the high velocity recording mode is used, a threshold value that is included in the threshold values extracted in the step E11 and corresponds to the current moving direction of the carriage 4 is set as the threshold value to be compared with the carriage velocity Vcr.

After that, the CPU 101 executes processing in steps E14 to E18 similar to the processing in the steps S14 to S18. Note that, in the jam recovery processing (the step E15, see FIG. 7A), the velocity obtaining operation in each of the steps B3 and B6 is executed both when the carriage 4 moves rightward and when the carriage 4 moves leftward, and the setting of the threshold value in each of the steps B4 and B7 is executed both when the carriage 4 moves rightward and when the carriage 4 moves leftward.

When the CPU 101 has determined that image recording on the sheet P is not yet completed (E18: NO), the CPU 101 controls the conveyance motor 45 to convey the sheet P frontward by a predefined conveyance amount (E19), and returns to the step E12. When the CPU 101 has determined that image recording on the sheet P is completed (E18: YES), the CPU 101 executes processing in steps E20 to E23 similar to the processing in the steps S22 to S25. Note that, in the paper-out recovery processing (the step E23, see FIG. 7C), the velocity obtaining operation in the step D2 is executed both when the carriage 4 moves rightward and when the carriage 4 moves leftward, and the setting of the threshold value in the step D3 is executed both when the carriage 4 moves rightward and when the carriage 4 moves leftward.

When the CPU 101 has determined in the step E5 that no recording command is received (E5: NO), the CPU 101 determines whether the temperature measured by the temperature sensor 98 is transited from the temperature range mapped to the threshold value set most recently to another temperature range (E24). When the CPU 101 has determined that the temperature measured by the temperature sensor 98 is not transited to another temperature range (E24: NO), the CPU 101 returns to the step E5. When the CPU 101 has determined that the temperature measured by the temperature sensor 98 is transited to another temperature range (E24: YES), the CPU 101 returns to the step E3 to set the threshold value for the high velocity recording mode again.

As described above, in the second embodiment, the velocity obtaining operation for each of the high image quality recording mode and the high velocity recording mode is executed when the carriage 4 moves rightward and when the carriage 4 moves leftward, and the setting of the threshold value for each of the high image quality recording mode and the high velocity recording mode is executed when the carriage 4 moves rightward and when the carriage 4 moves leftward. This results in an exact threshold value depending on the moving direction of the carriage 4. Further, when an image is recorded using the high velocity recording mode, the CPU 101 uses the threshold value that is stored in the threshold value table 104*a* while being mapped to the temperature range to which the temperature measured by the temperature sensor 98 belongs. This improves the accuracy of determination whether the jam is caused.

Third Embodiment

A third embodiment is explained below. In the third embodiment, when a difference between a current temperature measured by the temperature sensor 98 and a temperature mapped to a threshold value stored in the threshold value table 104*a* is equal to or more than a predefined value, the velocity obtaining operation and the setting of the threshold value for the high velocity recording mode are not executed. Instead, when the recording processing is executed using the high velocity recording mode, and when a difference between the current temperature measured by the temperature sensor 98 and a temperature measured by the temperature sensor 98 in the last velocity obtaining operation is equal to or more than the predefined value, a threshold value set based on the last velocity obtaining operation is corrected, and the corrected threshold value is used in the recording pass. The threshold value 104*a* of the non-volatile memory 104 stores two temperatures measured by the temperature sensor 98 in the last velocity obtaining operation for the high velocity recording mode and the velocity obtaining operation before the last for the high velocity recording mode, and two threshold values set in the respective velocity obtaining operations. In the following, the parts or components that are the same as or equivalent to those of the first embodiment are designated by the same reference numerals, any explanation of which is omitted as appropriate.

Referring to FIG. 9, a series of operations of the printer 1 according to the third embodiment is explained.

As depicted in FIG. 9, the CPU 101 first executes processing in steps F1 to F9 similar to the processing in the steps S1 to S9. When the CPU 101 has determined in the step S7 that the high velocity recording mode is used (F7: NO), the CPU 101 extracts a threshold value set most recently from the threshold value table 104*a* in the non-volatile memory 104 (F10). After that, the CPU 101 determines whether the difference between the current temperature measured by the temperature sensor 98 and the temperature stored in the threshold value table 104*a* is equal to or more than the predefined value (F11). When the CPU 101 has determined that the temperature difference is equal to or more than the predefined value (F11: YES), the CPU 101 corrects, through linear interpolation, the threshold value extracted in the step F10 based on the current temperature measured by the temperature sensor 98 and the threshold value table 104*a* (F12). Specifically, a threshold value corresponding to the current temperature measured by the temperature sensor 98 is calculated through the linear interpolation, which uses the two threshold values stored in the threshold value table 104*a* and the temperatures mapped to the two threshold values. The threshold value corrected in the step F12 is used as the threshold value for the recording processing using the high velocity recording mode. After completing the step F12, the CPU 101 proceeds to the step F13.

When the CPU 101 has determined in the step F11 that the temperature difference is less than the predefined value (F11: NO), the CPU 101 proceeds to the step F13 to use the threshold value extracted in the step F10 as the threshold value for the recording processing using the high velocity recording mode. Then, the CPU 101 executes processing in steps F13 to F27 similar to the processing in the step S11 to S25.

As described above, in the third embodiment, when an image is recorded using the high velocity recording mode, and when the difference between the current temperature measured by the temperature sensor 98 and the temperature measured by the temperature sensor 98 in the last velocity obtaining operation is equal to or more than the predefined value, the threshold value set most recently is corrected. This improves the accuracy of determination whether the jam is caused. The method of correcting the threshold value set most recently is not limited to the third embodiment. For example, a temperature measured by the temperature sensor 98 in the velocity obtaining operation executed in the past and history information of a threshold value that is set based on the velocity obtaining operation executed in the past may be stored. Then, the threshold value may be corrected based on the history information and the current temperature measured by the temperature sensor 98 through any other interpolation method than the linear interpolation.

Although some embodiments of the present disclosure are explained above, the present disclosure is not limited to the above embodiments, and a variety of modifications are possible without departing from the claims. For example, the velocity obtaining operation for the high velocity recording mode is not limited to those of the above embodiments, provided that it is executed in any other time than the warm-up time. For example, the velocity obtaining operation for the high velocity recording mode may be executed when the printer 1 is turned on (excluding the case in which the printer 1 is turned on for the first time), when the printer 1 recovers from a sleep mode, and the like. Alternatively, when the printer 1 is turned on, when the printer 1 recovers from the sleep mode, and the like, the difference between the current temperature measured by the temperature sensor 98 and the temperature measured by the temperature sensor 98 in the last velocity obtaining operation may be equal to or more than the predefined value. Only in that case, the velocity obtaining operation for the high velocity recording mode may be executed. The setting of the threshold value for the high velocity recording mode may be executed in the warm-up time instead of any other time than the warm-up time.

The method of setting the threshold value based on the velocity obtaining operation is not limited to those of the above embodiments. For example, a value smaller than an average value of multiple carriage velocities Vcr obtained in the velocity obtaining operation by a predefined amount may be set as the threshold value. Alternatively, the velocity obtaining operation for the return operation may be executed and a threshold value to be compared with the carriage velocity Vcr in the return operation may be set through that velocity obtaining operation.

In the above embodiments, the detection sensor 22 is configured to detect, as an index, each non-transmissive area 21*b* of the encoder 8. The detection sensor 22, however, may be configured to detect, as the index, each transmissive area 21*a* of the encoder 8. In the above embodiments, the encoder 8 is a transmissive linear encoder. The present disclosure, however, is not limited thereto. The encode 8 may be a reflective linear encoder. Further, the encoder 8 may be any other encoder than the optical encoder. For example, a magnetic encoder may be used. In that case, the non-transmissive areas 21*b* may be magnetic areas, and the transmissive areas 21*a* may be non-magnetic areas.

In the above embodiments, the CPU 101 determines whether the feed tray 51 is in the paper-out state based on the detection result of the remaining sheet detection sensor 56. The present disclosure, however, is not limited thereto. For example, the CPU 101 may determine that the feed tray 51 is in the paper-out state when a predefined time or longer has passed since the pickup roller 52 was driven to start the feeding of the sheet P and when the sheet sensor 38 detects no sheet P.

In the above embodiments, the carriage velocity Vcr corresponds to the velocity data of the present disclosure. The velocity data, however, may be a velocity parameter value relating to the carriage velocity Vcr instead of the carriage velocity Vcr itself. For example, the number of clocks CK may correspond to the velocity data of the present disclosure.

In the above embodiments, the high image quality recording mode corresponds to the first recording mode of the present disclosure and the high velocity recording mode corresponds to the second recording mode of the present disclosure. The present disclosure, however, is not limited thereto. For example, if the target velocity of the carriage 4 in the recording pass using the second recording mode is faster than that using the first recording mode, the resolution of an image to be recorded on the sheet P using the second recording mode is not required to be lower than that using the first recording mode, and the conveyance amount of the sheet P in the conveyance operation using the second recording mode is not required to be larger than that using the first recording mode.

If the recording time of second recording mode is longer than that of the first recording mode, the resolution of an image to be recorded on the sheet P using the second recording mode is not required to be lower than that using the first recording mode, the conveyance amount of the sheet P in the conveyance operation using the second recording mode is not required to be larger than that using the first recording mode, and the target velocity of the carriage 4 in the recording pass using the second recording mode is not required to be faster than that using the first recording mode. For example, if the first recording mode is used to record an image through the unidirectional recording and the second recording mode is used to record an image through the bidirectional recording, the first recording mode and the second recording mode may have the same conditions as follows: the target velocity of the carriage 4 in the recording pass; the resolution of the image; the conveyance mount of the sheet P in the conveyance operation; and the discharge amount of ink from the head 5.

If the discharge amount of ink from the head 5 using second recording mode is smaller than that using the first recording mode, the resolution of an image to be recorded on the sheet P using the second recording mode is not required to be lower than that using the first recording mode, the conveyance amount of the sheet P in the conveyance operation using the second recording mode is not required to be larger than that using the first recording mode, and the recording time of the second recording mode is not required to be shorter than that of the first recording mode.

In the above embodiments, when the CPU has determined that the jam is caused in the recording pass, movement of the carriage 4 is stopped to suspend the recording pass. The present disclosure, however, is not limited thereto. The carriage 4 may move toward a direction opposite to the moving direction of the carriage 4 in the above recording pass. Since the head 5 is not brought into contact with the sheet P until the CPU 101 determines that the jam is caused, the head 5 is not likely to be brought into contact with the sheet P during movement of the carriage 4 in the direction opposite to the moving direction. Accordingly, the head 5 is not likely to be damaged and the jam is not likely to worsen during movement of the carriage 4 in the direction opposite to the moving direction.

The temperature sensor 98 obtains the temperature itself. The temperature sensor 98, however, may obtain a parameter value relating to the temperature. The parameter may have a larger value as the temperature rises, or the parameter may have a smaller value as the temperature rises.

Examples in which the present disclosure is applied to the printer that records an image on the sheet P by discharging ink from nozzles are explained above. The present disclosure, however, is not limited thereto. The present disclosure may be applied to an image recording apparatus that records an image by discharging a liquid on any other recording medium than the sheet P. For example, the present disclosure may be applied to an image recording apparatus that records an image on a wiring board by discharging any other liquid than ink, such as material of a wiring pattern. Further, the present disclosure may be applied to an image recording apparatus that records an image on a medium, such as resin, cardboard, and cases of mobile terminals including smartphones, by discharging ink thereon.

What is claimed is:

1. An image recording apparatus, comprising:

a carriage configured to move in a scanning direction;

a head carried on the carriage and configured to discharge a liquid;

a velocity sensor configured to obtain velocity data related to a velocity of the carriage, and a controller configured to:

control the velocity sensor to obtain the velocity data while controlling the carriage to move;

determine a threshold value based on the velocity data;

execute, in a case of receiving a recording command, a recording pass in which the liquid is discharged from the head toward a recording medium during movement of the carriage to record an image on the recording medium;

determine in execution of the recording pass whether a velocity indicated by the velocity data is lower than a velocity corresponding to the threshold value; and suspend the recording pass in a case that the controller has determined in execution of the recording pass that the velocity indicated by the velocity data is lower than the velocity corresponding to the threshold value, wherein the controller is configured to:

select a recording mode related to recording of the image from among a first recording mode and a second recording mode in which the velocity of the carriage in the recording pass is faster than the first recording mode and obtain the velocity data and determine the threshold value for each of the first recording mode and the second recording mode, the velocity data for the first recording mode is obtained in a warm-up time after the recording command is received until recording of the image is started, and the velocity data for the second recording mode is obtained in any other time than the warm-up time.

2. The image recording apparatus according to claim 1, wherein the controller is configured to suspend the recording pass by stopping movement of the carriage in the case that the controller has determined in execution of the recording pass that the velocity indicated by the velocity data is lower than the velocity corresponding to the threshold value.

3. The image recording apparatus according to claim 1, further comprising a temperature sensor and a memory, wherein the controller is configured to control the memory to store temperature data related to a temperature that is measured by the temperature sensor in a case that the velocity data for the second recording mode is obtained most recently, and the controller is configured to obtain the velocity data for the second recording mode in a case that a difference between a measured temperature and a stored temperature is equal to or more than a predefined value, the measured temperature being measured using the temperature sensor and indicated by the temperature data, the stored temperature being indicated by the temperature data stored in the memory.

4. The image recording apparatus according to claim 1, further comprising a temperature sensor and a memory, wherein the controller is configured to control the memory to store temperature data related to a temperature that is measured by the temperature sensor in a case that the velocity data for the second recording mode is obtained most recently, and the controller is configured to correct the threshold value for the second recording mode in a case that a difference between a measured temperature and a stored temperature is equal to or more than a predefined value, the measured temperature being measured using the temperature sensor and indicated by the temperature data, the stored temperature being indicated by the temperature data stored in the memory.

5. The image recording apparatus according to claim 1, further comprising a temperature sensor and a memory, wherein the controller is configured to map a temperature range, to which a belonging temperature that is measured using the temperature sensor in the case of obtaining the velocity data for the second recording mode and is indicated by the temperature data belongs, to the threshold value determined based on the velocity data, and the controller is configured to control the memory to store the temperature range and the threshold value mapped to the temperature range, a plurality of threshold values each of which is mapped to the temperature range are stored in the memory, and the controller is configured to use the threshold value that is included in the threshold values stored in the memory and is mapped to the temperature range to which the belonging temperature belongs, in the case that the image is recorded using the second recording mode and that the controller determines in execution of the recording pass whether the velocity indicated by the velocity data is lower than the velocity corresponding to the threshold value.

6. The image recording apparatus according to claim 1, wherein the controller is configured to obtain the velocity data for the second recording mode in a case that the image recording apparatus is turned on for the first time.

7. The image recording apparatus according to claim 1, wherein, in a case that the controller has determined to suspend recording in a time period after the recording command is received until the recording of the image related to the recording command ends, the controller is configured to obtain the velocity data for the second recoding mode in a time period after the recording is suspended until the recording is restarted.

8. The image recording apparatus according to claim 7, wherein in a case that the controller has determined in execution of the recording pass for the recording of the image related to the recording command that the velocity indicated by the velocity data is lower than the velocity corresponding to the threshold value, the controller is configured to determine to suspend the recording.

9. The image recording apparatus according to claim 7, further comprising a feeder configured to feed the recording medium, wherein the image is recorded on the recording medium fed by the feeder, and the controller is configured to:

determine whether the feeder is out of the recording medium to be fed; and determine to suspend recording in a case that the controller has determined in execution of the image recording that the feeder is out of the recording medium.

10. The image recording apparatus according to claim 1, wherein in the case of the image recording, the controller is configured to:

execute a plurality of recording passes, execute the recording pass for each of a case in which the carriage moves toward a first side in the scanning direction and a case in which the carriage moves toward a second side being opposite to the first side in the second direction, and obtain the velocity data and determine the threshold value for each of the first recording mode and the second recording mode every time a moving direction of the carriage changes.

11. The image recording apparatus according to claim 1, wherein, in the case of the image recording, the controller is configured to:

execute a plurality of recording passes, execute the recording pass only in a case that the carriage moves toward a first side in the scanning direction execute, at timing between two consecutive recording passes included in the recording passes, a return operation in which the carriage moves toward a second side being opposite to the first side in the scanning direction without discharging the liquid from the head, and in the return operation, the controller is configured to determine whether the velocity indicated by the velocity data that is obtained during movement of the carriage is lower than a predefined value determined depending on a target velocity of the carriage.

12. The image recording apparatus according to claim 1, wherein in the case of obtaining the velocity data, the controller is configured to obtain a plurality of velocity data while moving the carriage at a constant velocity, and in the case of determining the threshold value, the controller is configured to determine the threshold value based on slowest velocity data included in the plurality of velocity data and having a slowest velocity among the plurality of velocity data.

13. An image recording apparatus, comprising:

a carriage configured to move in a scanning direction;

a head carried on the carriage and configured to discharge a liquid;

a velocity sensor configured to obtain velocity data related to a velocity of the carriage, and a controller configured to:

control the velocity sensor to obtain the velocity data while controlling the carriage to move;

determine a threshold value based on the velocity data; and record an image on a recording medium, in a case of receiving a recording command, by generating discharge data that is used to discharge the liquid from the head based on image data to be recorded and by executing a recording pass in which the liquid is discharged from the head toward the recording medium based on the discharge data during movement of the carriage;

determine in execution of the recording pass whether a velocity indicated by the velocity data is lower than a velocity corresponding to the threshold value; and suspend the recording pass in a case that the controller has determined in execution of the recording pass that the velocity indicated by the velocity data is lower than the velocity corresponding to the threshold value, wherein the controller is configured to:

select a recording mode related to recording of the image from among a first recording mode and a second recording mode, wherein a recording time required for the second recording mode is shorter than that required for the first recording mode if an image is recorded on the recording medium based on identical image data, and obtain the velocity data and determine the threshold value for each of the first recording mode and the second recording mode, the velocity data for the first recording mode is obtained in a warm-up time after the recording command is received until recording of the image is started, and the velocity data for the second recording mode is obtained in any other time than the warm-up time.

14. The image recording apparatus according to claim 13, further comprising a conveyer configured to convey the recording medium in a conveyance direction intersecting with the scanning direction, wherein the controller is configured to record the image on the recording medium by alternately executing the recording pass and a conveyance operation in which the conveyer conveys the recording medium in the conveyance direction, and a conveyance amount of the recording medium in the conveyance operation using the first recording mode is smaller than that using the second recording mode.

15. The image recording apparatus according to claim 13, wherein a resolution of the image to be recorded on the recording medium using the first recording mode is higher than that using the second recording mode.

16. An image recording apparatus, comprising:

a carriage configured to move in a scanning direction;

a head carried on the carriage and configured to discharge a liquid;

a velocity sensor configured to obtain velocity data related to a velocity of the carriage, and a controller configured to:

control the velocity sensor to obtain the velocity data while controlling the carriage to move;

determine a threshold value based on the velocity data;

execute, in a case of receiving a recording command, a recording pass in which the liquid is discharged from the head toward a recording medium during movement of the carriage to record an image on the recording medium;

determine in execution of the recording pass whether a velocity indicated by the velocity data obtained is lower than a velocity corresponding to the threshold value; and suspend the recording pass in a case that the controller has determined in execution of the recording pass that the velocity indicated by the velocity data is lower than the velocity corresponding to the threshold value, wherein the controller is configured to:

select a recording mode related to recording of the image from among a first recording mode and a second recording mode in which a discharge amount of the liquid to be discharged from the head is smaller than that of the first recording mode; and obtain the velocity data and determine the threshold value for each of the first recording mode and the second recording mode, the velocity data for the first recording mode is obtained in a warm-up time after the recording command is received until recording of the image is started, and the velocity data for the second recording mode is obtained in other time other than the warm-up time.

* * * * *